US009149711B1

(12) United States Patent
Kavarsky, Jr. et al.

(10) Patent No.: US 9,149,711 B1
(45) Date of Patent: Oct. 6, 2015

(54) SNOWBOARD BINDING AND BOOT

(71) Applicant: The Burton Corporation, Burlington, VT (US)

(72) Inventors: Raymond Robert Kavarsky, Jr., Bozeman, MT (US); Christopher M. Doyle, Waterbury, VT (US); Scott T. Keller, Waterbury Center, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 14/542,131

(22) Filed: Nov. 14, 2014

(51) Int. Cl.
*A63C 10/02* (2012.01)
*A63C 10/10* (2012.01)
*A43B 5/04* (2006.01)

(52) U.S. Cl.
CPC ..... *A63C 10/103* (2013.01); *A43B 5/0401* (2013.01); *A63C 10/02* (2013.01)

(58) Field of Classification Search
CPC ..... A63C 10/10; A63C 10/103; A63C 10/24; A63C 10/106; A63C 10/18; A63C 10/285; A63C 10/22; A63C 10/08; A43B 5/0401; A43B 5/0403; A43B 5/0423; A43B 5/0456; A43B 5/0474
USPC ..... 280/624, 613, 618
See application file for complete search history.

(56) References Cited

U.S. PATENT DOCUMENTS

| | | | |
|---|---|---|---|
| 1,735,359 | A | 11/1929 | Proctor |
| 1,815,168 | A | 7/1931 | Sprague |
| 1,973,444 | A | 9/1934 | Reinar |
| 2,449,242 | A | 9/1948 | Millard |
| 3,271,040 | A | 9/1966 | Spademan |
| 3,606,370 | A | 9/1971 | Spademan |
| 3,955,825 | A | 5/1976 | Kubelka et al. |
| 4,097,062 | A | 6/1978 | Salomon |
| 4,113,275 | A | 9/1978 | Sherwin |
| 4,125,274 | A | 11/1978 | Kubelka et al. |
| 4,162,089 | A | 7/1979 | Alber |
| 4,196,921 | A | 4/1980 | Sherwin |
| 4,352,508 | A | 10/1982 | Spademan |

(Continued)

FOREIGN PATENT DOCUMENTS

| | | |
|---|---|---|
| DE | 19846005 C1 | 5/2000 |
| DE | 10031332 A1 | 1/2002 |

(Continued)

*Primary Examiner* — Brodie Follman
*Assistant Examiner* — Brian Cassidy
(74) *Attorney, Agent, or Firm* — Wolf, Greenfield & Sacks, P.C.

(57) ABSTRACT

A snowboard boot and binding system is disclosed which facilitates the engagement and disengagement of a snowboard boot and binding. The snowboard boot may include a boot engagement member extending from a rear of the boot. The boot engagement member is moved downwardly into a corresponding binding engagement member to provide an arrangement which prevents forward movement of the boot. The boot engagement member also may include one or more serrations to engage with one or more pawls on the binding to prevent upward movement of the boot. A snap-in arrangement may be provided in a boot toe region. The boot has protrusions extending outwardly from each side of the boot to engage with catches on the binding sidewalls. As the boot is pressed downwardly into the binding, the protrusions splay the catches until reaching recesses, at which point the catches rebound to capture the protrusions against upward movement.

30 Claims, 27 Drawing Sheets

(56) References Cited

U.S. PATENT DOCUMENTS 4,358,131 A 11/1982 Schwartz
4,395,055 A 7/1983 Spademan
4,395,058 A 7/1983 Terrell
4,403,789 A 9/1983 Hickey
4,492,387 A 1/1985 Spademan
4,537,419 A 8/1985 Kiernan
4,598,933 A 7/1986 Hoelzl
4,624,473 A 11/1986 Knabel et al.
4,973,073 A 11/1990 Raines et al.
5,042,177 A 8/1991 Schoch
5,062,226 A 11/1991 Sartor et al.
5,344,179 A 9/1994 Fritschi et al.
5,369,897 A 12/1994 Rullier
5,425,161 A 6/1995 Schoch
5,435,080 A 7/1995 Meiselman
5,474,322 A 12/1995 Perkins et al.
5,505,477 A 4/1996 Turner et al.
5,505,478 A 4/1996 Napoliello
5,520,406 A 5/1996 Anderson et al.
5,556,123 A 9/1996 Fournier
5,584,492 A 12/1996 Fardie
5,636,455 A 6/1997 Meiselman
5,660,410 A 8/1997 Alden
5,690,351 A 11/1997 Karol
5,692,765 A 12/1997 Laughlin et al.
5,695,210 A 12/1997 Goss et al.
5,697,631 A 12/1997 Ratzek et al.
5,713,587 A 2/1998 Morrow et al.
5,713,594 A 2/1998 Jenni
5,722,680 A 3/1998 Dodge
5,727,797 A 3/1998 Bowles
5,769,446 A 6/1998 Borsoi
5,785,566 A 7/1998 Blanger
5,794,362 A 8/1998 Polk, III et al.
5,799,957 A 9/1998 Okajima et al.
5,799,975 A 9/1998 Crick
5,803,481 A 9/1998 Eaton et al.
5,806,876 A 9/1998 Alden
5,853,188 A 12/1998 Alden
5,871,226 A 2/1999 Klubitschko et al.
5,890,730 A 4/1999 Anderson et al.
5,894,684 A 4/1999 Sand et al.
5,901,471 A 5/1999 Warner
5,901,971 A 5/1999 Eaton
5,909,894 A 6/1999 Meader et al.
5,913,530 A 6/1999 Berger et al.
5,918,897 A 7/1999 Hansen et al.
5,924,719 A 7/1999 Girard
5,938,913 A 8/1999 Starcevic et al.
5,941,553 A 8/1999 Korman
5,944,337 A 8/1999 Girard et al.
5,954,358 A 9/1999 Bejean et al.
5,957,479 A 9/1999 Bayer et al.
5,957,480 A 9/1999 Dodge
5,966,843 A 10/1999 Sand et al.
5,970,632 A 10/1999 Watson
5,971,407 A 10/1999 Zemke et al.
5,971,422 A 10/1999 Anderson et al.
5,997,027 A 12/1999 Jungkind
6,017,042 A 1/2000 Paris
6,017,050 A 1/2000 Girard
6,024,375 A 2/2000 Johnson
6,050,589 A 4/2000 Couderc et al.
6,050,590 A 4/2000 Domon
6,053,524 A 4/2000 Laughlin
6,062,586 A 5/2000 Korman
6,092,829 A 7/2000 Mercier
6,102,429 A * 8/2000 Laughlin et al. ..... 280/617
6,105,992 A 8/2000 Schaller et al.
6,105,995 A 8/2000 Zill
6,105,996 A 8/2000 France
6,109,643 A 8/2000 Bayer et al.
6,123,354 A 9/2000 Laughlin et al.
6,126,179 A 10/2000 Dodge
6,135,486 A 10/2000 Neiley
6,145,868 A 11/2000 Schaller et al.
6,155,591 A 12/2000 Huffman et al.
6,189,913 B1 2/2001 Morrow et al.
6,196,559 B1 3/2001 Cress
6,206,403 B1 3/2001 Black et al.
6,209,890 B1 4/2001 Couderc
6,209,903 B1 4/2001 Girard
6,213,493 B1 4/2001 Korman
6,226,897 B1 5/2001 Sand
6,247,252 B1 6/2001 Parisotto
6,247,709 B1 6/2001 Couderc
6,267,390 B1 7/2001 Maravetz et al.
6,267,403 B1 7/2001 Bossin et al.
RE37,319 E 8/2001 Meiselman
6,270,110 B1 8/2001 Laughlin et al.
6,283,482 B1 9/2001 Coulter
6,289,610 B1 9/2001 Girard et al.
6,290,243 B1 9/2001 Beran
6,290,250 B1 9/2001 Karol
6,293,578 B1 9/2001 Anderson et al.
6,302,411 B1 10/2001 Huffman et al.
6,302,427 B1 10/2001 Karol
6,302,428 B1 10/2001 Jungkind
6,308,980 B1 10/2001 Karol
6,315,305 B1 11/2001 Gien
6,322,096 B2 11/2001 Porte
6,325,405 B2 12/2001 Okajima
6,343,809 B1 2/2002 Karol
6,357,781 B1 3/2002 Jeandin
6,357,783 B1 3/2002 Okajima et al.
6,374,517 B2 4/2002 Girard et al.
6,382,641 B2 5/2002 Dennis et al.
6,386,574 B1 5/2002 Tanaka
6,406,040 B1 6/2002 Thorne
6,416,074 B1 7/2002 Maravetz et al.
6,450,525 B2 9/2002 Reuss et al.
6,450,526 B1 9/2002 Bressand
6,460,865 B2 10/2002 Keller et al.
6,467,795 B1 10/2002 Hirayama et al.
6,499,757 B1 12/2002 Berger et al.
6,520,511 B2 2/2003 Gonthier
6,523,852 B2 2/2003 Gignoux et al.
6,530,590 B2 3/2003 Okajima et al.
6,533,295 B2 3/2003 Gonthier
6,536,795 B2 3/2003 Okajima et al.
6,540,248 B2 4/2003 Anderson et al.
6,554,295 B2 4/2003 Rittmeyer
6,557,865 B1 5/2003 Reuss et al.
6,581,944 B1 * 6/2003 Marmonier et al. ..... 280/14.22
6,595,542 B2 7/2003 Okajima
6,637,768 B2 10/2003 Okajima et al.
6,648,364 B2 11/2003 Okajima et al.
6,663,138 B1 12/2003 Zanatta et al.
6,672,610 B2 1/2004 Freisinger et al.
6,684,534 B2 2/2004 Dodge
6,698,787 B1 3/2004 Gignoux et al.
6,705,633 B2 3/2004 Poscich
6,705,634 B2 3/2004 Anderson et al.
6,722,060 B2 4/2004 Okajima
6,722,688 B2 4/2004 Poscich
6,726,238 B2 4/2004 Poscich
6,729,641 B2 5/2004 Okajima et al.
6,733,030 B2 5/2004 Okajima et al.
6,733,031 B2 5/2004 Okajima et al.
6,742,800 B2 6/2004 Okajima
6,758,488 B2 7/2004 Laughlin et al.
6,767,026 B2 7/2004 Gignoux et al.
6,802,524 B2 10/2004 Karol
6,814,367 B2 11/2004 Mercier et al.
6,824,159 B2 11/2004 Okajima et al.
6,855,023 B2 2/2005 Berger et al.
6,883,255 B2 4/2005 Morrow et al.
6,886,849 B2 5/2005 Mandon
6,896,285 B2 5/2005 Gignoux et al.
6,910,706 B2 6/2005 Holzer et al.
6,938,913 B2 9/2005 Elkington
6,966,563 B2 11/2005 Harrison
6,976,684 B2 12/2005 Carrasca
6,991,240 B2 1/2006 Grella et al.

(56) References Cited

U.S. PATENT DOCUMENTS

| | | | | |
|---|---|---|---|---|
| 7,011,334 | B2 * | 3/2006 | Holzer | 280/618 |
| 7,047,673 | B2 | 5/2006 | Dodge | |
| 7,073,809 | B2 | 7/2006 | Holzer | |
| 7,073,813 | B2 | 7/2006 | Martin et al. | |
| 7,073,814 | B2 | 7/2006 | Okajima et al. | |
| 7,111,865 | B2 | 9/2006 | Girard | |
| 7,159,892 | B2 | 1/2007 | Draper et al. | |
| 7,168,710 | B1 | 1/2007 | Hennebry | |
| 7,207,592 | B2 | 4/2007 | Pascal et al. | |
| 7,210,252 | B2 | 5/2007 | Morrow et al. | |
| 7,219,930 | B2 | 5/2007 | Kiernan | |
| 7,232,132 | B2 | 6/2007 | Elkington | |
| 7,232,147 | B2 | 6/2007 | Couderc | |
| 7,232,148 | B2 | 6/2007 | Gonthier | |
| 7,246,811 | B2 | 7/2007 | Martin | |
| 7,264,264 | B2 | 9/2007 | Girard | |
| 7,316,412 | B2 | 1/2008 | Couderc | |
| 7,320,191 | B2 | 1/2008 | Trinkaus et al. | |
| 7,320,474 | B2 | 1/2008 | Quellais et al. | |
| 7,334,810 | B2 | 2/2008 | Holzer et al. | |
| 7,357,406 | B2 | 4/2008 | Krumbeck et al. | |
| 7,367,579 | B2 | 5/2008 | Elkington | |
| 7,393,000 | B2 | 7/2008 | Resch et al. | |
| 7,444,769 | B2 | 11/2008 | Hall et al. | |
| 7,469,911 | B2 | 12/2008 | Sanders | |
| 7,487,992 | B2 | 2/2009 | Pascal et al. | |
| 7,568,719 | B2 | 8/2009 | Sauter | |
| 7,575,252 | B2 | 8/2009 | Smith | |
| 7,618,053 | B2 | 11/2009 | Marega et al. | |
| 7,621,542 | B2 | 11/2009 | Warburton et al. | |
| 7,637,036 | B2 | 12/2009 | Sellers et al. | |
| 7,699,678 | B2 | 4/2010 | Cannon | |
| 7,766,711 | B2 | 8/2010 | Crumrine | |
| 7,823,905 | B2 | 11/2010 | Ritter | |
| 7,823,907 | B1 | 11/2010 | Coholan | |
| 7,832,754 | B2 | 11/2010 | Girard et al. | |
| 7,887,080 | B2 | 2/2011 | Hauglin | |
| 7,931,292 | B2 | 4/2011 | Miralles | |
| 7,959,181 | B2 | 6/2011 | Weissenberger | |
| 7,988,180 | B2 | 8/2011 | Holzer et al. | |
| 7,992,888 | B2 | 8/2011 | Steere | |
| 8,016,315 | B2 | 9/2011 | Neiley et al. | |
| 8,052,157 | B2 | 11/2011 | Holzer | |
| 8,091,901 | B2 | 1/2012 | Haskell | |
| 8,172,252 | B2 | 5/2012 | Elkington | |
| 8,267,421 | B2 | 9/2012 | Krenn et al. | |
| 8,322,730 | B2 | 12/2012 | Sorenson | |
| 8,328,225 | B2 | 12/2012 | Prigge et al. | |
| 8,371,605 | B2 | 2/2013 | Neiley et al. | |
| 8,388,013 | B2 | 3/2013 | Indulti | |
| 8,424,168 | B2 | 4/2013 | Soderberg et al. | |
| 8,544,870 | B2 | 10/2013 | Elkington | |
| 8,584,381 | B2 | 11/2013 | Plake | |
| 8,747,340 | B2 | 6/2014 | Gerber et al. | |
| 8,752,845 | B2 | 6/2014 | Elkington | |
| 2001/0010422 | A1 | 8/2001 | Merino et al. | |
| 2001/0030411 | A1 | 10/2001 | Arnell et al. | |
| 2002/0024187 | A1 | 2/2002 | Gyr | |
| 2002/0027335 | A1 | 3/2002 | Hale | |
| 2002/0089150 | A1 | 7/2002 | Musho et al. | |
| 2004/0075246 | A1 * | 4/2004 | Davies et al. | 280/623 |
| 2004/0232656 | A1 | 11/2004 | Gyr | |
| 2004/0232658 | A1 | 11/2004 | Poscich | |
| 2011/0049821 | A1 | 3/2011 | Trabucchi | |
| 2011/0185596 | A1 | 8/2011 | Girard | |
| 2011/0271557 | A1 | 11/2011 | Barthel | |
| 2011/0298196 | A1 | 12/2011 | Lehner | |
| 2012/0042542 | A1 | 2/2012 | Lehner | |
| 2012/0299255 | A1 | 11/2012 | Farges | |
| 2013/0062862 | A1 | 3/2013 | Andersson et al. | |
| 2013/0097892 | A1 | 4/2013 | Viniero et al. | |
| 2013/0113184 | A1 | 5/2013 | Pelchat | |
| 2013/0334795 | A1 | 12/2013 | Alzner et al. | |

FOREIGN PATENT DOCUMENTS

| | | | |
|---|---|---|---|
| DE | 10223151 | A1 | 11/2003 |
| EP | 374729 | A2 | 6/1990 |
| EP | 707873 | A1 | 4/1996 |
| EP | 930087 | A1 | 7/1999 |
| EP | 1247552 | A1 | 10/2002 |
| EP | 1249259 | A2 | 10/2002 |
| EP | 1300180 | A2 | 4/2003 |
| FR | 2351617 | A1 | 12/1977 |
| FR | 2732230 | A1 | 10/1996 |
| FR | 2742997 | A1 | 7/1997 |
| FR | 2742998 | A1 | 7/1997 |
| FR | 2769238 | A1 | 4/1999 |
| JP | 08-150237 | A | 6/1996 |
| JP | 3040809 | U | 5/1997 |
| JP | H10-244032 | A | 9/1998 |
| JP | H11-192337 | A | 8/1999 |
| JP | H11-206952 | A | 8/1999 |
| JP | 3070043 | U | 7/2000 |
| JP | 2000-237370 | A | 9/2000 |
| JP | 2005-137580 | A | 6/2005 |
| JP | 2006-288850 | A | 10/2006 |
| JP | 2008-086577 | A | 4/2008 |
| WO | WO 97/18016 | A1 | 5/1997 |
| WO | WO 97/28858 | A1 | 8/1997 |
| WO | WO 99/15245 | A1 | 4/1999 |
| WO | WO 00/69532 | A1 | 11/2000 |
| WO | WO 00/76337 | A1 | 12/2000 |
| WO | WO 03/063632 | A1 | 8/2003 |
| WO | WO 2005/049156 | A2 | 6/2005 |
| WO | WO 2007/034080 | A1 | 3/2007 |
| WO | WO 2012/058451 | A1 | 5/2012 |
| WO | WO 2013/028918 | A1 | 2/2013 |

* cited by examiner

SNOWBOARD BINDING AND BOOT

FIELD

This application relates generally to securing a boot to a gliding board, and more particularly to boot binding arrangements and components thereof to secure a snowboard boot to a snowboard.

RELATED ART

Conventional bindings for soft snowboard boots include strap bindings and step-in bindings. With strap bindings, one or more straps are used to secure the snowboard boot to the binding. With step-in bindings, one or more strapless engagement members releasably engage with the boot to secure the boot in the binding.

BRIEF DESCRIPTION OF THE DRAWINGS

Various embodiments of the invention will now be described, by way of example, with reference to the accompanying drawings, in which.

SUMMARY

Figure 1:
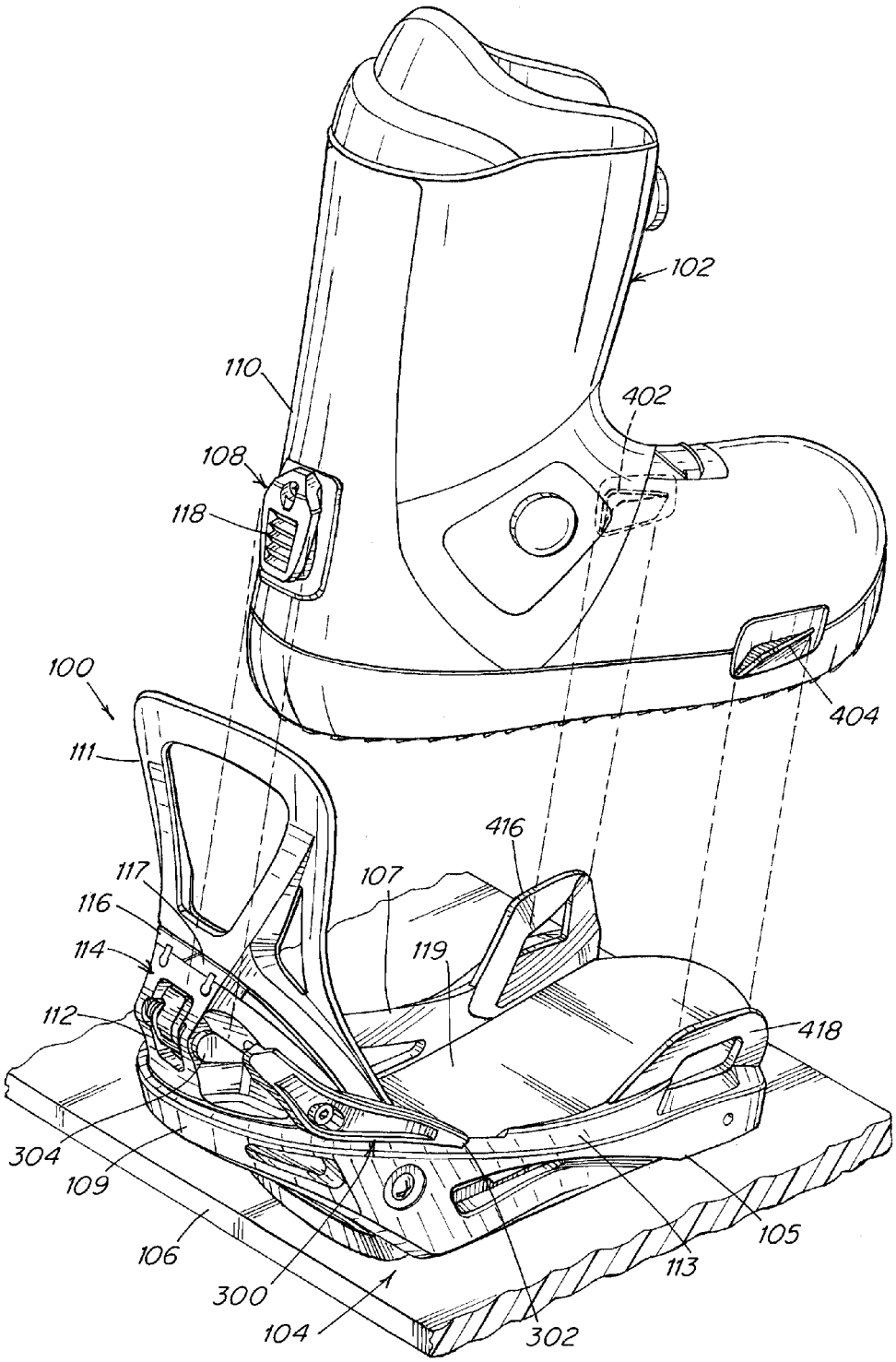
FIG. 1 is a perspective view of one illustrative embodiment of a boot about to be secured to a binding.

According to one embodiment, an apparatus includes a snowboard boot having a cleat located in a rear region of the boot, with the cleat at least partially securing a snowboard boot to a snowboard binding. The cleat is elongated in a generally heel-calf direction, and the cleat forms a T-shape in a cross section taken perpendicular to the direction of elongation of the cleat. The T-shape of the cleat configured to be received in the binding to limit forward movement of the boot.

According to another embodiment, an apparatus includes a snowboard boot and a boot engagement member coupled to the snowboard boot to at least partially secure the snowboard boot to a snowboard binding. The boot engagement member includes a support coupled to and extending rearwardly away from a rearwardly-facing region of a snowboard boot, and a first forwardly-facing contact surface attached to the support to resist forward movement of the boot through contact with the binding when the snowboard boot is engaged with the snowboard binding. The first forwardly-facing surface is elongated in an up-down direction.

In a further embodiment, an apparatus includes a snowboard boot and a boot engagement member to at least partially secure the snowboard boot to a snowboard binding, with the boot engagement member being located on a rear of the snowboard boot. The boot engagement member includes a forwardly-facing contact surface which counteracts forward forces on the boot via contact with the binding when the boot is engaged with a snowboard binding. A rearward direction force on the forwardly-facing contact surface pulls rearwardly on the boot at a location on the boot that is directly forward of an area where the forwardly-facing contact surface contacts the binding. The boot engagement member also includes a first engagement element on the boot engagement member which is engageable with a binding engagement member to resist upward movement of the snowboard boot when the boot engagement member is attached to a snowboard boot and is engaged with a snowboard binding. The boot engagement member further includes a second engagement element on the boot engagement member which is engageable with a binding engagement member to resist upward movement of the snowboard boot when the boot engagement member is attached to a snowboard boot and is engaged with a snowboard binding, the second engagement element being positioned higher on the boot engagement member than the second interface engagement element.

According to another embodiment, an apparatus includes a snowboard boot and a cleat extending rearwardly away from a rear of the boot, the cleat including a support and a forwardly-facing surface extending transversely to the support and spaced from the rear of the boot. The apparatus also includes a binding to secure the boot to a snowboard, the binding having a rearwardly-facing surface located in a rear section of the binding. When the boot is secured to the binding, the forwardly-facing surface of the cleat contacts the rearwardly-facing surface of the binding to limit forward movement of the boot relative to the binding, and the cleat is prevented from upward movement out of the binding. While the forwardly-facing surface is prevented from upward movement out of the binding, the forwardly-facing surface and the rearwardly facing surface are able to contact one another to limit forward movement of the boot relative to the binding in either of two or more different positions of the rear of the boot relative to the rear section of the binding in an up-down direction.

According to another embodiment, a snowboard binding includes a base having a toe-heel direction and defining medial and lateral sides and a central region between the sides, and a binding engagement member at a rear of the base in the central region and constructed and arranged to at least partially secure a boot to the base. The binding also includes a release handle mounted to the base and constructed and arranged to release the binding engagement member from at least partially securing the boot. The release handle includes an actuation portion and a graspable portion, the graspable portion extending generally in the heel-toe direction along a side of the base, and the actuation portion being offset from the graspable portion toward the central region and operatively coupled to the binding engagement member.

According to another embodiment, a snowboard binding includes a base and a binding engagement member at the rear of the base in a central region between sides of the base. The binding engagement member is constructed and arranged to at least partially secure a boot to the base, and the binding engagement member has a first pawl having a first engagement surface to engage a serration on a snowboard boot, the first pawl having a first pivot axis. The binding also includes a release handle movable in a first direction to rotate the first pawl about the first pivot axis in a first rotation direction. Rotation of the first pawl in a second rotation direction opposite to the first rotation direction does not move the release handle.

According to a further embodiment, a binding to secure a snowboard boot to a snowboard includes a base and a binding engagement apparatus mounted to the base. The binding engagement apparatus including a first pawl having a first engagement surface to engage a serration on a rearwardly-facing portion of a snowboard boot, and a second pawl having a second engagement surface to engage a serration on a rearwardly-facing portion of a snowboard boot, the first pawl rotatable about a first pivot axis, and the second pawl rotatable about a second pivot axis. The first and second pivot axes are one of: 1) the same pivot axis, and 2) separate pivot axes wherein the pivot axis of the second pawl is lower on the binding than the pivot axis of the first pawl. The binding includes a release handle to release at least one of the first and second engagement surfaces from a serration on a rearwardly-facing portion of a snowboard boot.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

DETAILED DESCRIPTION

Gliding board binding systems are described herein which improve a rider's experience by providing a convenient and robust arrangement for inserting and attaching a boot to a gliding board binding, holding the boot while riding, and removing the boot from the binding. The present disclosure is described with respect to snowboards, snowboard boots, and snowboard bindings, though the disclosure is not limited in this regard. Accordingly, aspects of the present disclosure may be employed with releasably attaching any suitable footwear to a sporting or recreational device. Examples of such footwear include hiking boots, winter boots, ski boots, and hard or soft snowboard boots. Examples of sporting or recreational devices that include snow shoes, skates, skis, snowboards, crampons or any other device require secure releasable attachment of footwear to the device.

Bindings have been developed to secure a soft snowboard boot to a binding and generally are either considered a strap binding, wherein one or more straps attached to the binding wrap over a portion of the boot and draw the boot into the binding as the straps are tightened. Step-in snowboard bindings on the other hand typically include movable engagement members that automatically engage with engagement members on the boot as a user (also referred to as a rider in the case of a snowboard user) "steps" into the binding. In this regard, the engagement members have an open position and a closed position, and a rider may insert and attach his boot to a binding without having to manipulate the binding in any way beyond pressing his boot into the binding. The movable engagement members on the binding are releasable by the user typically by manipulating a release device. Often, the only action required of the rider to remove the boot from the binding, other than foot movement, is simply actuating a release lever, such as pulling on a release handle. Some step-in bindings have two moveable engagement members—one to engage each side of a snowboard boot. Other step-in binding arrangements include a rear binding engagement member that engages a corresponding boot engaging member located at the back of the boot, whereas the toe region of the boot is held to the binding either by other suitable arrangements. Further, some step-in bindings may be considered hybrid bindings where an interface device can be secured to the footwear using straps, such as conventional ratchet straps employed in strap bindings, and the interface device itself includes the engagement features necessary to engage a step-in binding.

According to one aspect of the present disclosure, a step-in binding system includes a boot engagement member (which may also be referred at as a cleat) positioned on the rear of the boot, and the boot engagement member engages with a corresponding engagement member on the binding when the boot is moved into the binding. The boot engagement member may include a forward-facing surface to contact a rearward-facing surface of the binding in some embodiments. This arrangement of the forward-facing and rearward facing surfaces resists forward movement of the boot relative to the binding when the boot is mounted to the binding. In some embodiments, the boot engagement member is coupled to the backstay or heel region of the boot. In another embodiment, the engagement boot engagement member may be attached to a rear portion of a binding interface that can be attached to the boot my some other arrangement such as straps.

The boot engagement member also may include one or more serrations which interact with one or more pawls on the binding. The pawls prevent upward movement of the boot heel relative to the binding when the boot is mounted to the binding. The pawls may be arranged so that as the boot engagement member moves into the binding, the pawls pass over the serrations until the boot heel reaches its final, lowest position, which may or may not be the position at which the boot sole contacts the binding baseplate or the snowboard, which can occur should snow, ice or debris accumulate between the boot sole and binding baseplate or the top surface of the snowboard, as will be explained below. In this final position, the pawls prevent upward movement of the boot by contacting the serrations. A release assembly including a handle actuated by the rider may be provided to release the pawl(s) from the serration(s), and thereby allow the boot to be moved upwardly and out of the binding.

As mentioned briefly above, when two or more serrations, or other engagement features, are provided on the boot engagement member, the overall arrangement accommodates snow, ice or debris should the same accumulate underneath the heel region of the boot. With such an accumulation, the boot heel is not depressed as far down into the binding as compared to a binding free of such matter. In such a circumstance, the binding engagement member (e.g., including pawl(s)) engages with a serration positioned lower down on the boot backstay. In this manner, the binding and boot can accommodate this foreign matter buildup without any active adjustments by the rider to the binding or boot. As the foreign matter dissipates, whether through compaction, melting or otherwise, the weight of the rider and/or as the rider exerts downward forces while riding, the boot will continue to automatically ratchet down into the binding The use of a rear engagement arrangement can deliver a more desirable feel or performance in some embodiments when compared to a typical step-in binding. In some embodiments, the use of a rear engagement arrangement also may permit the to use of a less rigid sole or less rigid regions of a sole in the boot as compared to typical step-in binding systems. In some embodiments, a sole and cushion region may be similar to the type of sole and cushion region found in boots used with strap bindings.

According to another aspect of embodiments herein, to release the boot from the binding, a release assembly is arranged on the binding such that actuation is convenient for the rider.

Removal of the boot from the binding results in the binding being in a state where the binding can again accept the boot for securement without requiring the rider to actively prepare any portion of the binding or boot, according to one aspect of some embodiments.

According to a further aspect of embodiments disclosed herein, the mid-region and/or toe region of the boot may be secured to the binding also via a step-in arrangement where a feature or features on the boot move a portion or portions of the binding away from an initial position as the boot moves into the binding. Once the boot passes a threshold position, the displaced portion(s) move or snap back toward their respective initial positions and capture one or more engagement members on the boot. In some embodiments, the boot feature which displaces the binding portion also acts as the engagement portion. In some embodiments, the captured engagement member(s) are prevented from moving upwardly, but forward movement is not prevented by the toe-region portion of the binding.

For example, a snowboard boot may have a medial-side protrusion that extends sideways and upwardly from the toe region of the boot. And a similar protrusion may extend sideways and upwardly on the lateral side of the boot toe region. The binding may have an engagement feature such as a catch extending upwardly from the sidewall on each of the medial side and lateral side of the binding. As the boot is pressed into the binding, bottom surfaces of the protrusions splay the catches of the binding away from a longitudinal binding centerline. Once the tips of the protrusions pass a threshold location, the catch and/or sidewall structure allows the catches to move or snap back toward the longitudinal centerline, and the catches engage with the protrusions to prevent movement of the boot toe in at least one direction. In some embodiments, the engagement prevents upward movement of the boot toe relative to the binding.

Further still, in some embodiments, instead of the binding portion splaying open as the boot is stepped-into the binding, the engagement portion on the boot moves away from the portion of the binding. In this regard, the boot construction may be more pliable or flexible than the binding such that as the mid-region and/or toe region of the boot is stepped-into the binding, the boot yields allowing the protrusions to move past the binding portion. As the boot continues its downward step-in motion, the protrusions clear the binding portion and thus the boot expands back laterally and medially outward, such that now the binding portion resides above the boot protrusions preventing or limiting upward movement of the toe and/or mid-region of the boot. Of course, in some embodiments, the protrusion on the boot may be substituted for a recess that engages with the binding portion. In this example, again the boot construction may be more pliable or flexible than the binding such that the mid-region and/or toe region is compressed or contracted inward as the boot is stepped-into the binding, yielding to allow the recesses to move past the relatively stationary binding portion. As the boot continues its downward step-in motion, and as the region below the recesses clears the binding portion, the recess allows the boot to expand back laterally and medially outward, such that now the binding portion can now engage with the recess preventing or limiting upward movement of the toe and/or mid-region of the boot.

According to an aspect, removal or even movement of the boot toe in an upward direction by again splaying the sidewalls is not possible through movement of the boot alone in some embodiments. For example, the protrusions on the boot and the engagement features on the sidewalls may be constructed and arranged such that pulling upwardly on the boot, twisting the boot about a vertical axis, and/or twisting the boot about a longitudinal axis do not sufficiently splay the sidewalls to permit disengagement of the boot in a direction approximately opposite to the direction of engagement. Instead, in some embodiments, each of the sidewalls has a path that leads forwardly, and when other engagements of the boot are released (e.g., the heel engagement as described above), the protrusions and thus the boot can be moved forwardly through the path to a sidewall exit. In this manner, the toe engagement may be released without splaying the sidewalls, or, in some embodiments, without any action by the rider beyond forward movement of the boot relative to the binding. In other embodiments, forward rotation (pitch) of the toe region of the boot may aid in removing protrusions from the catches.

In some embodiments, the binding system includes the combination of a rear engagement member arrangement and the toe region engagement arrangement briefly described above. Because such a system allows the toe region arrangement to prevent only upward movement in some embodiments, release of only the rear engagement member can permit forward removal of the boot in some embodiments.

Also, as noted above with respect to the rear engagement, the forward engagement members may also be included on an interface device. In this regard, the interface may be secured to the boot, whether by employing straps or other attachment arrangements, and the interface engagement members engage the forward engagement features on the binding. It should be appreciated that the interface may be a unitary device having both the rear and forward engagement members or two separate interfaces may be employed, with a rear interface incorporating the rear engagement feature or features and the forward interface incorporating the forward engagement feature or features.

In some embodiments, the snowboard boot and binding system include engagement features on the boot that engage with the binding that are outside the periphery of the rider's foot. In this regard, no portion of the engagement feature would be disposed under the rider's foot such that rider would be standing on a typical snowboard boot sole, such as that found in conventional soft snowboard boots for strap type bindings, rendering the boot more comfortable to the rider.

In addition to various boot and binding structures used to achieve the aspects described above, methods of use are described herein. Not all aspects described herein are required to be present in any given embodiment, nor is any one particular aspect require to be present in any given embodiment.

One embodiment of a snowboard binding system 100 is shown in FIG. 1, and includes a boot 102 in position to be inserted into a binding 104 that is attached to a snowboard 106. The binding 104 includes a base 105 with opposed medial and lateral sides each having a sidewall (a medial sidewall 107 on the medial side and a lateral sidewall 113 on the lateral side). In some embodiments, the binding includes a heel hoop 109 which extends around a rider's heel and connects heel-side ends of the sidewalls 107, 113. In this embodiment, the sidewalls and the heel hoop are molded as a single unitary piece, though these components may be separately made and then attached together. A heel cup 112 extends around a rider's heel between the heel-side ends of the sidewalls 107, 113. In embodiments including a heel hoop, the heel cup is positioned on top of the heel hoop 109 and below a portion of a highback 111. In embodiments without a heel hoop, the heel cup connects heel-side ends of the sidewalls 107, 113. In the illustrated embodiment, two inserts 115, 117 are sandwiched between the heel cup 112 and the highback 111. Inserts 115, 117 of various thicknesses may be used to vary the forward lean of the highback 111. In some embodiments, no inserts are used, and other arrangements may be provided for forward lean adjustment, if any.

The base 105 of the binding may include a baseplate or may be free of a baseplate. A footbed 119 may be provided, which may be removably or permanently attached to the base (i.e., to the baseplate). If no baseplate is provided, the footbed may lie atop the upper surface of the snowboard. The binding may be attached to a snowboard or other gliding board in any suitable manner, for example with fasteners that attach to a pattern of holes in the snowboard, or with a channel-type attachment arrangement.

Figure 2:
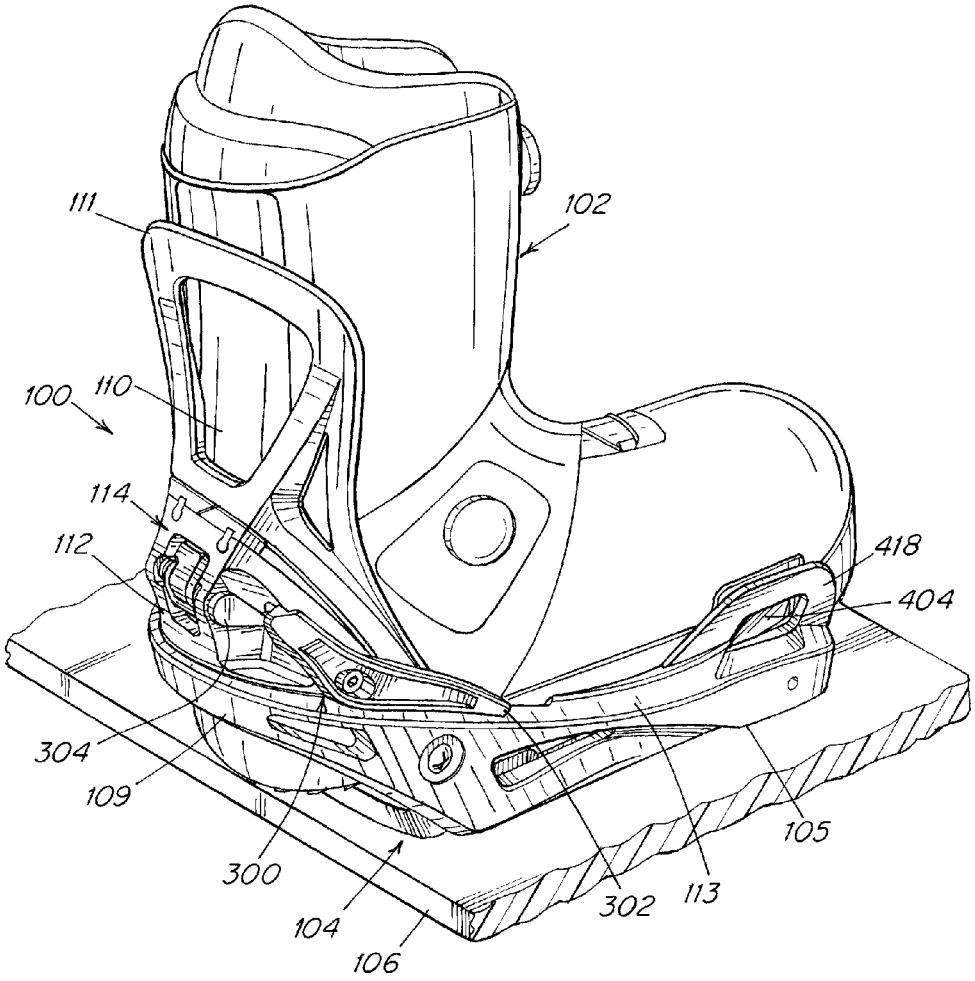
FIG. 2 is a perspective view of the boot of FIG. 1 secured to the binding of FIG. 1 according to one aspect.

A boot engagement member 108 is positioned on the rear of a backstay 110 of boot 102, though the boot engagement member may be positioned on the heel or the rear of the shaft of the boot in some embodiments. In one embodiment, heel cup 112 of binding 104 has a binding engagement member 114 with which boot engagement member 108 engages. In this embodiment, as will be more fully described below, engagement of boot engagement member 108 and binding engagement member 114 prevents release of the boot in both the forward and upward directions. Though in other embodiments, the binding engagement member 114 may prevent release of the boot in only one direction. FIG. 2 shows the boot secured to the binding.

Figure 3:
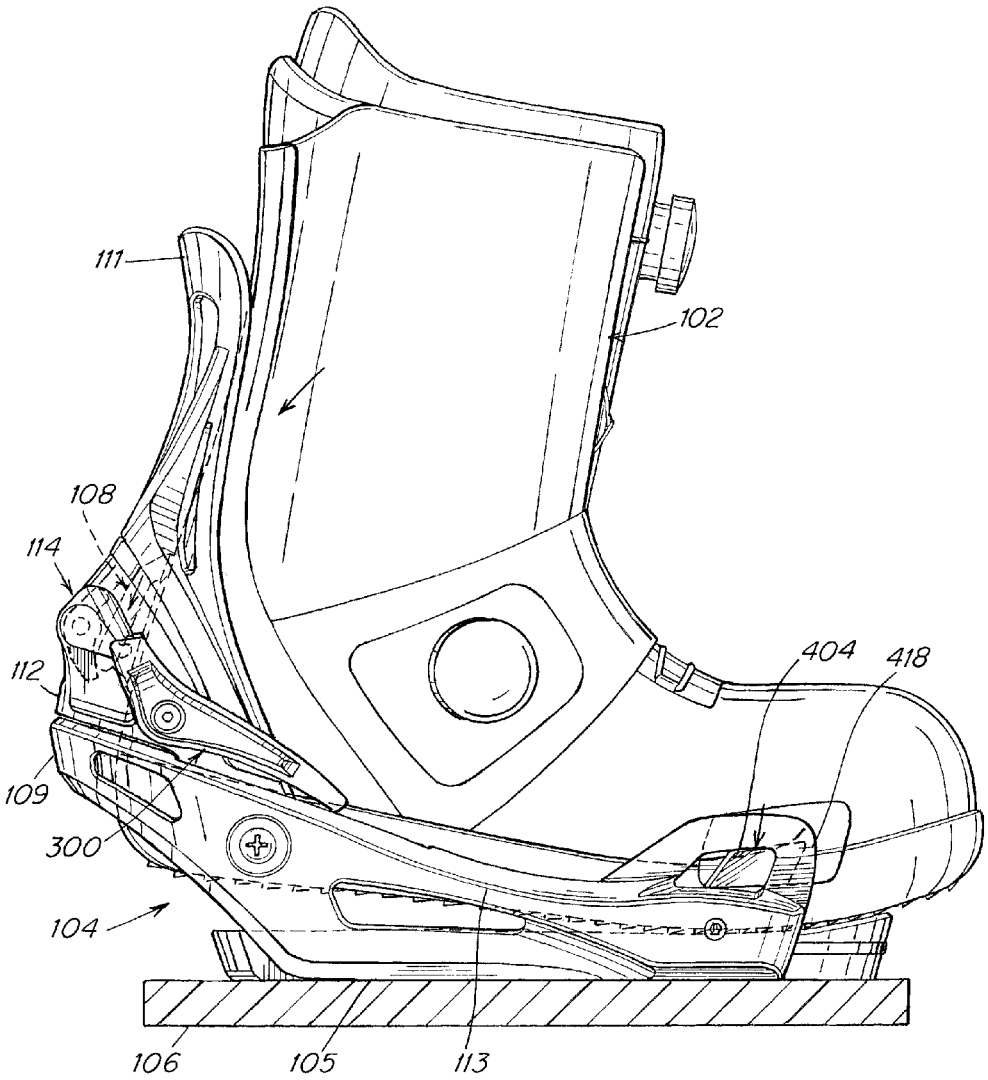
FIG. 3 is a side view of a toe region of the boot of FIG. 1 being inserted into the binding of FIG. 1 according to one aspect.
Figure 4:
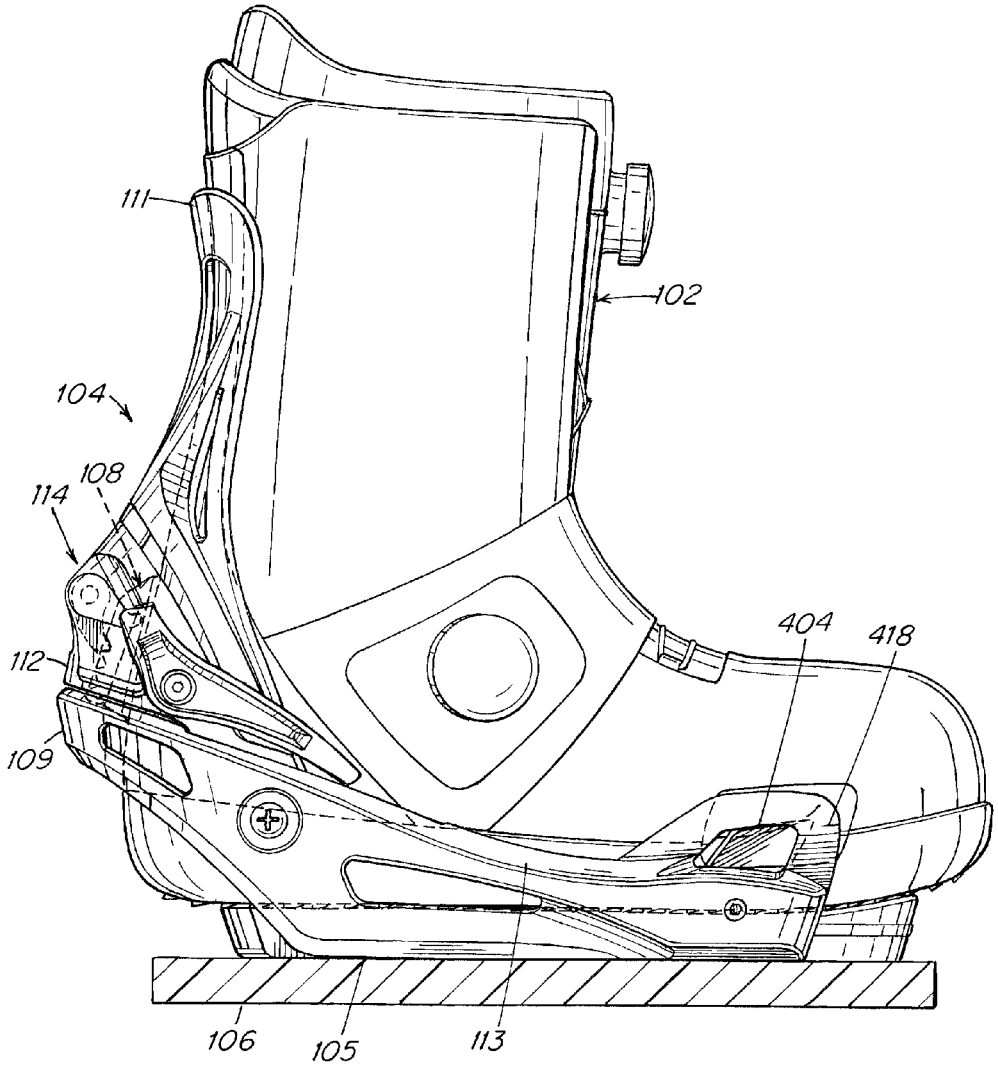
FIG. 4 is a side view of the boot of FIG. 1 secured to the binding of FIG. 1 according to one aspect.
Figure 5:
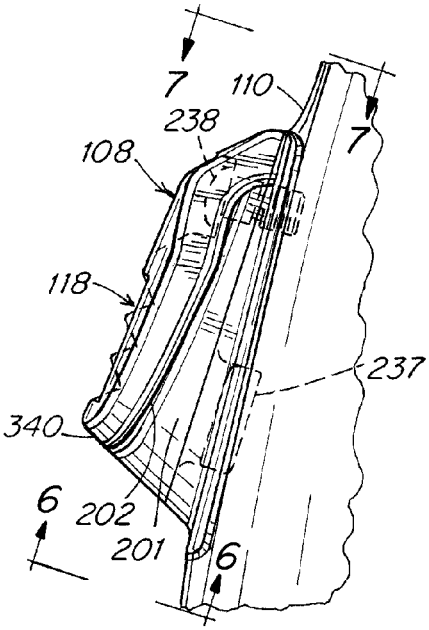
FIG. 5 is a side view of boot engagement member extending from a rear of the boot according to one aspect.
Figure 6:
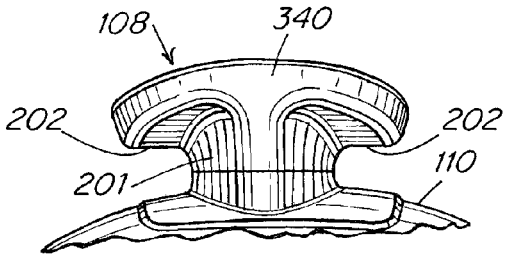
FIG. 6 is a bottom view of the boot engagement member of FIG. 5 as seen along line 6-6 of FIG. 5.
Figure 7:
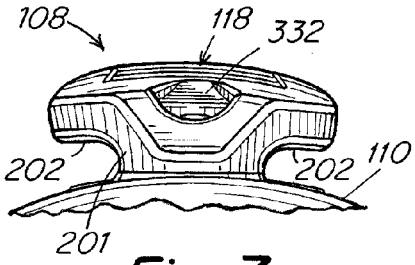
FIG. 7 is a top view of the boot engagement member of FIG. 5 as seen along line 7-7 of FIG. 5.
Figure 8:
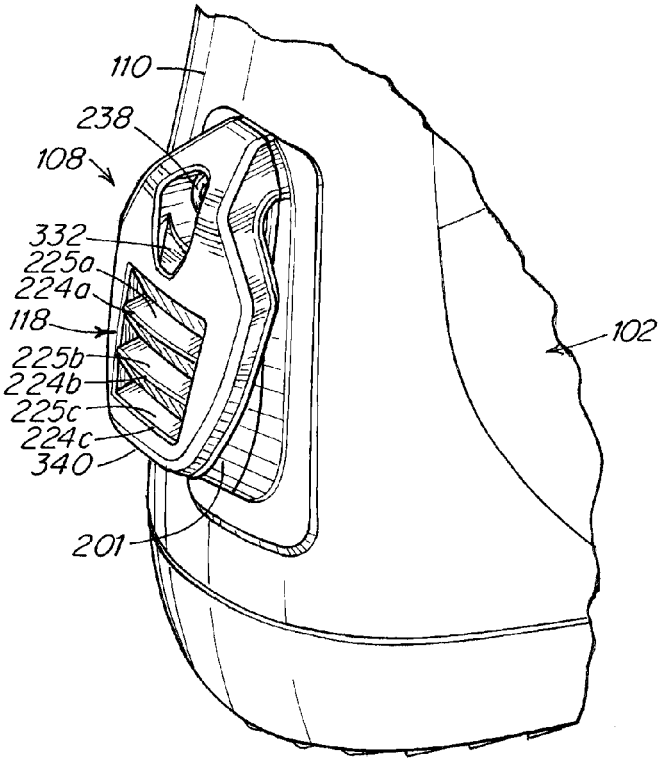
FIG. 8 is a perspective view of the boot engagement member of FIG. 5.

A toe region of the boot includes one or more protrusions 402, 404 which engage with a corresponding catches 416, 418 on the binding. FIG. 3 shows protrusion 402 engaged with the catch after the toe region of the boot has been pressed into the binding. As shown, the rear portion of the boot is then pressed downwardly to engage boot engagement member 108 with binding engagement member 114. Though, it should be appreciated that the toe region engagement may occur prior to, simultaneously with, or after engagement of the rear boot engagement member 108 and binding engagement member 114. FIG. 4 shows the front and rear portions of the boot secured to the binding.

Prevention of Forward Boot Movement

To prevent removal of the boot in the forward direction, the boot engagement member 108, in one embodiment, has a T-shaped cross section. In one embodiment, the boot engagement member 108 includes a support member 201 (e.g., the base of the "T") from which one or more forward-facing contact surfaces 202 extend (e.g., the top cross-piece of the "T"), as shown, for example, in FIGS. 5, 6, 7, 9, and 10. The support member 201 extends rearwardly from a rearwardly-facing region of the boot. It should be appreciated that other suitably shaped cross sections may be employed, such as one where the boot engagement member 108 includes only a wing to one side, such as may be the case with an upside-down L-shaped cross section. It should also be appreciated that the same cross-sectional shape need not extend along the full length of the boot engagement member. For example, a T-shaped cross section may extend along a portion of the length of the boot engagement member and then an upside-down L-shaped cross section may extend along another portion of the length of the boot engagement member. In some embodiments, the T-shaped cross section extends along a majority of the length of the boot engagement member. Other combinations also may be employed.

In the illustrated embodiment, the forward-facing contact surfaces 202 extend from a distal end of the support member, but in some embodiments, the forward-facing contact surfaces 202 may extend from the support member at a position which is forward of the distal end of the support member. For example, the forward-facing contact surfaces 202 may extend to the sides at a position between the attachment of the support member to the boot and the distal end of the support member.

Figure 9:
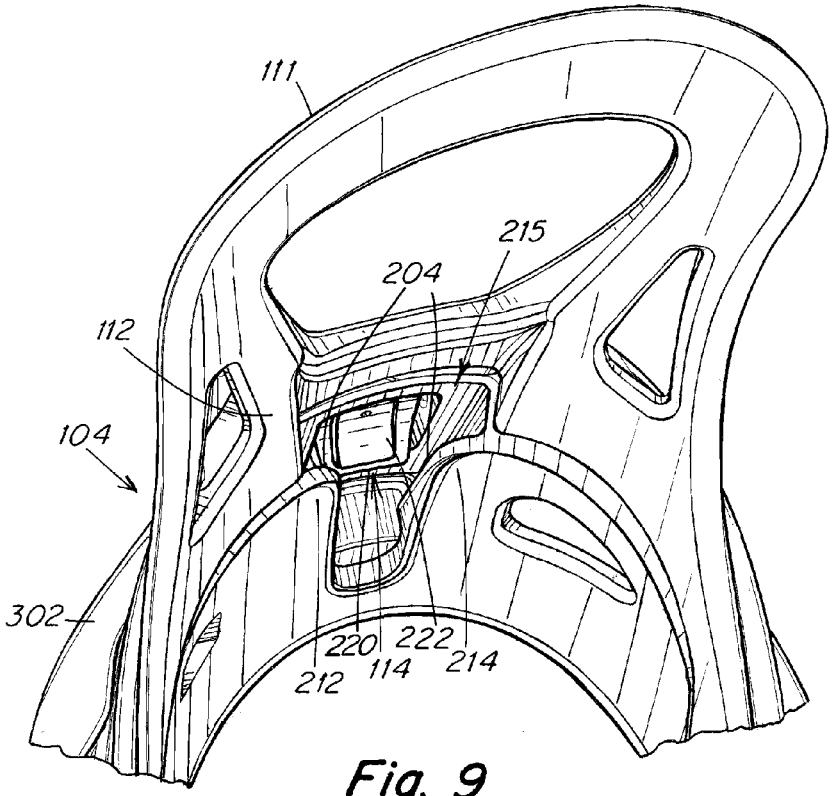
FIG. 9 is a top perspective view of a binding engagement member according to one aspect.
Figure 15:
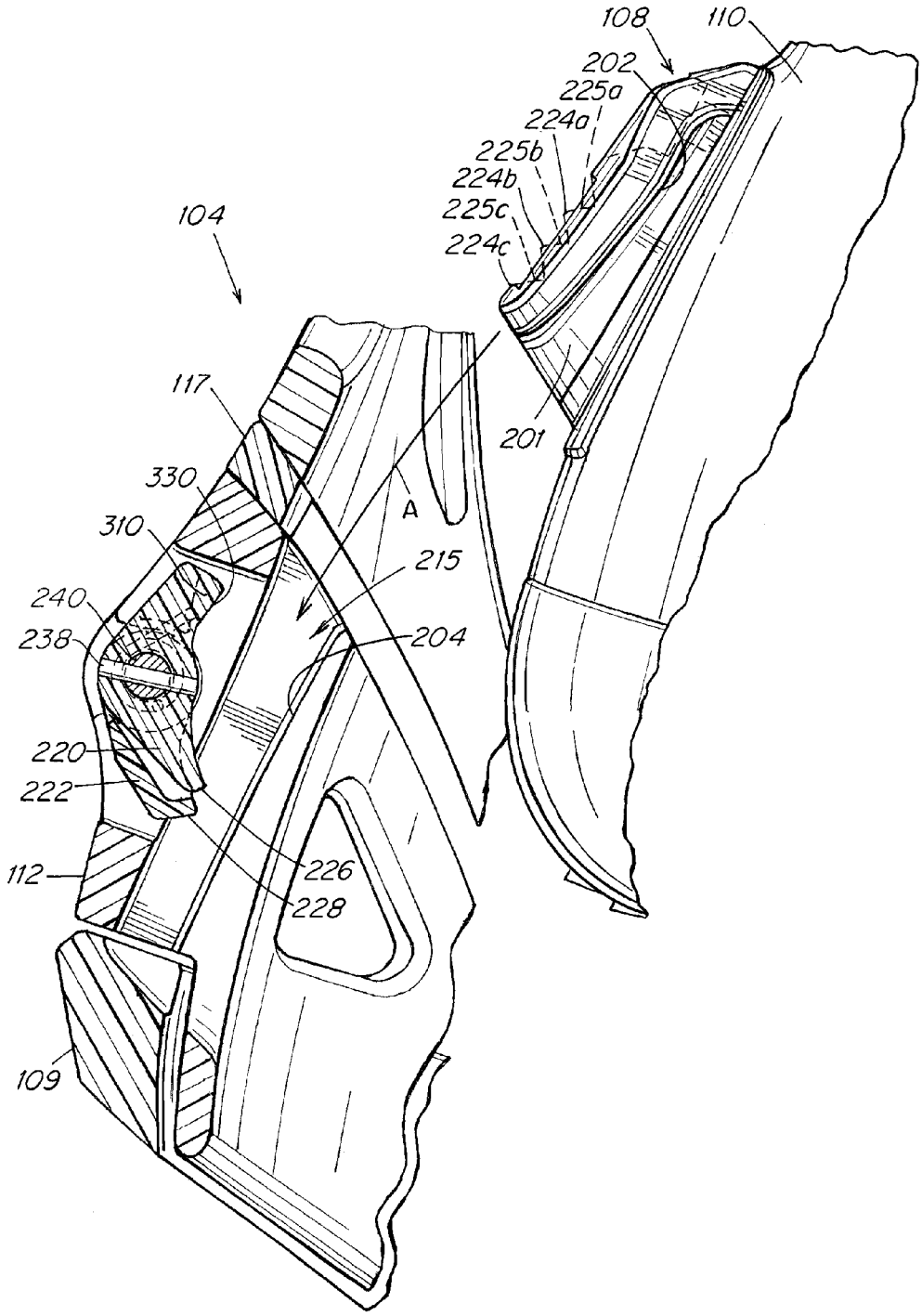
FIG. 15 is a partial cross-sectional side view of the boot engagement member about to engage with the binding engagement member according to one aspect.

Forward-facing contact surfaces 202 are arranged to contact one or more rearward-facing contact surfaces 204 of the binding engagement member 114 to prevent forward motion and removal of the boot from the binding. For example, as shown in FIGS. 9 and 15, binding engagement member 114 may include heel cup portions 212, 214 which include rearward-facing contact surfaces 204. When the boot is pulled forward, the forward-facing contact surface 202 will contact the heel cup portions 212, 214, and prevent the boot from moving forward within the binding to any significant degree.

One or both of the rearward-facing contact surface and the forward-facing contact surface may be elongated, for example in an up-down direction to provide contact regions having significant surface area and/or to permit the boot to accommodate snow, ice or debris buildup in the binding or on the underside of the boot. In one embodiment, the elongated direction may be a heel-calf direction of the boot. By having an elongated contact surface 202 and/or an elongated contact surface 204, the boot engagement member 108 can vary in its engaged height relative to the binding, and still be able to contact the binding engagement member to prevent forward movement of the boot.

One of the forward-facing contact surface 202 and the rearward-facing contact surface 204 may not be elongated in an up-down direction in some embodiments, while the other contact surface is elongated in an up-down direction. In such embodiments, the binding system is still able to accommodate foreign matter buildup because an elongated region exists for one contact surface to contact the other contact surface. Or, in some embodiments, materials having suitable properties may be used such that small contact regions are sufficient for securing the boot in the binding.

The forward-facing contact surface (e.g., forward-facing surface 202) does not need to be perpendicular or substantially perpendicular to the forward direction to be considered forward-facing. Instead, as long as the surface is transverse to the forward direction, and an axis normal to the surface has a forward direction component to it, the surface may be considered a forward-facing surface. In some embodiments, the forward-facing surface is substantially perpendicular to the forward direction, and in some embodiments, the forward-facing surface is perpendicular to the forward direction.

In some embodiments, a total surface area of forwardly-facing surfaces may be approximately ten $cm^2$. In other embodiments, the total surface area may be greater than ten $cm^2$, less than ten $cm^2$, less than five $cm^2$, or less than one $cm^2$.

The elongation in an up-down direction does not necessarily mean that the direction of elongation is strictly vertical relative to a snowboard, nor does it necessarily mean that the direction of the elongation is parallel to the rear of the boot, though in some embodiments, the direction of elongation of the boot engagement member may be vertical or may be parallel to the rear of the boot. For purposes herein, the direction of elongation is considered to be elongated in an up-down direction when the elongation direction has a vertical component relative to a snowboard and the boot is secured to the snowboard via the binding. In some embodiments, such an up-down direction can be the heel-calf direction.

Figure 10:
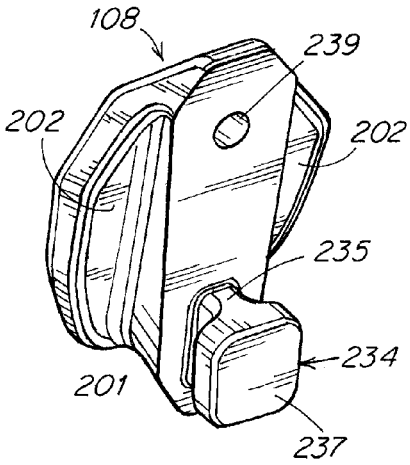
FIG. 10 shows the boot engagement member removed from the boot.
Figure 11:
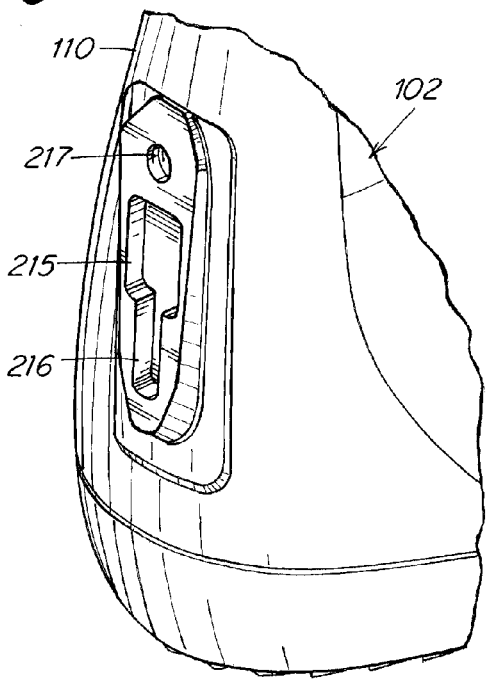
FIG. 11 shows the rear of the boot including a receptacle for receiving the boot engaging member.
Figure 12:
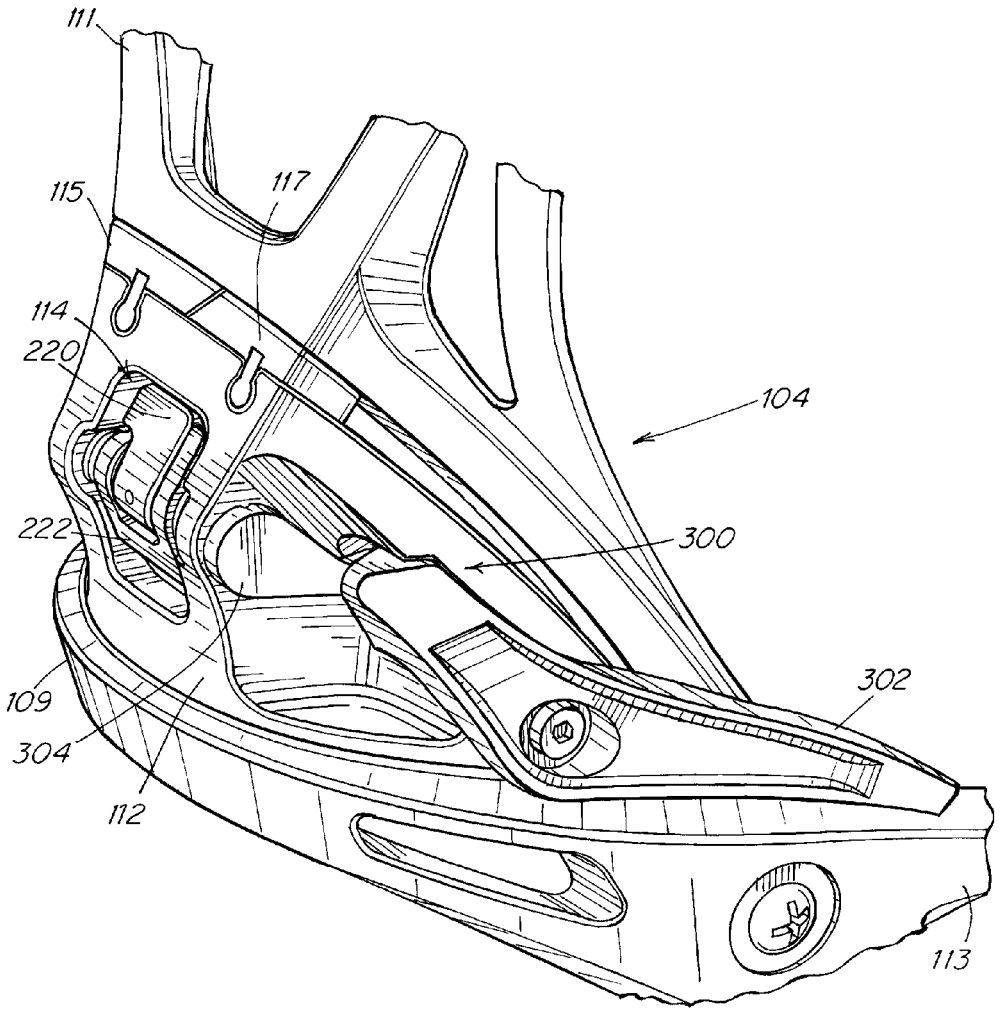
FIG. 12 is a perspective view of the binding engagement member of FIG. 9 according to one aspect.
Figure 13:
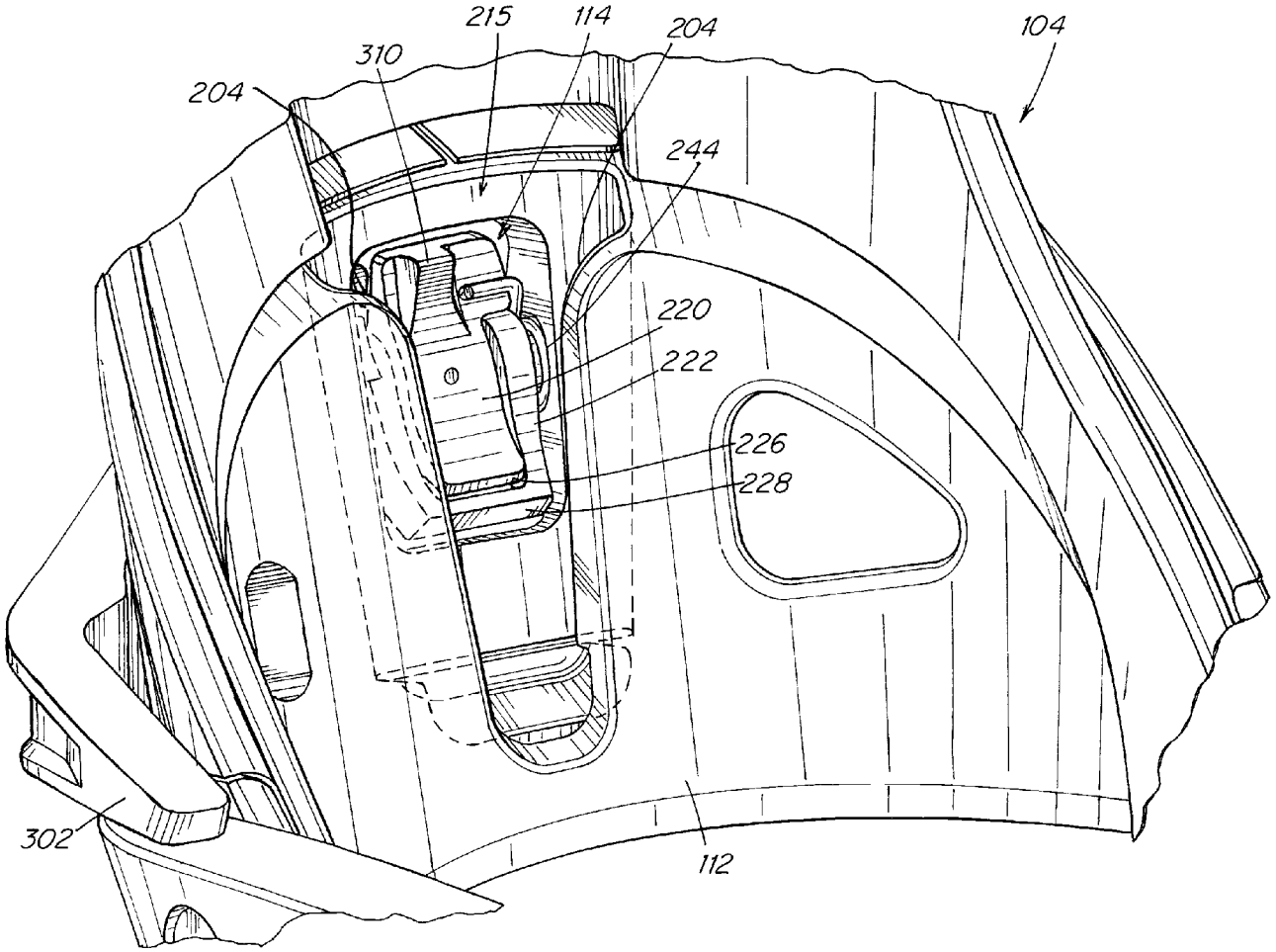
FIG. 13 shows the binding engagement member of FIG. 12 from the boot-facing side of the binding, according to one aspect.
Figure 14:
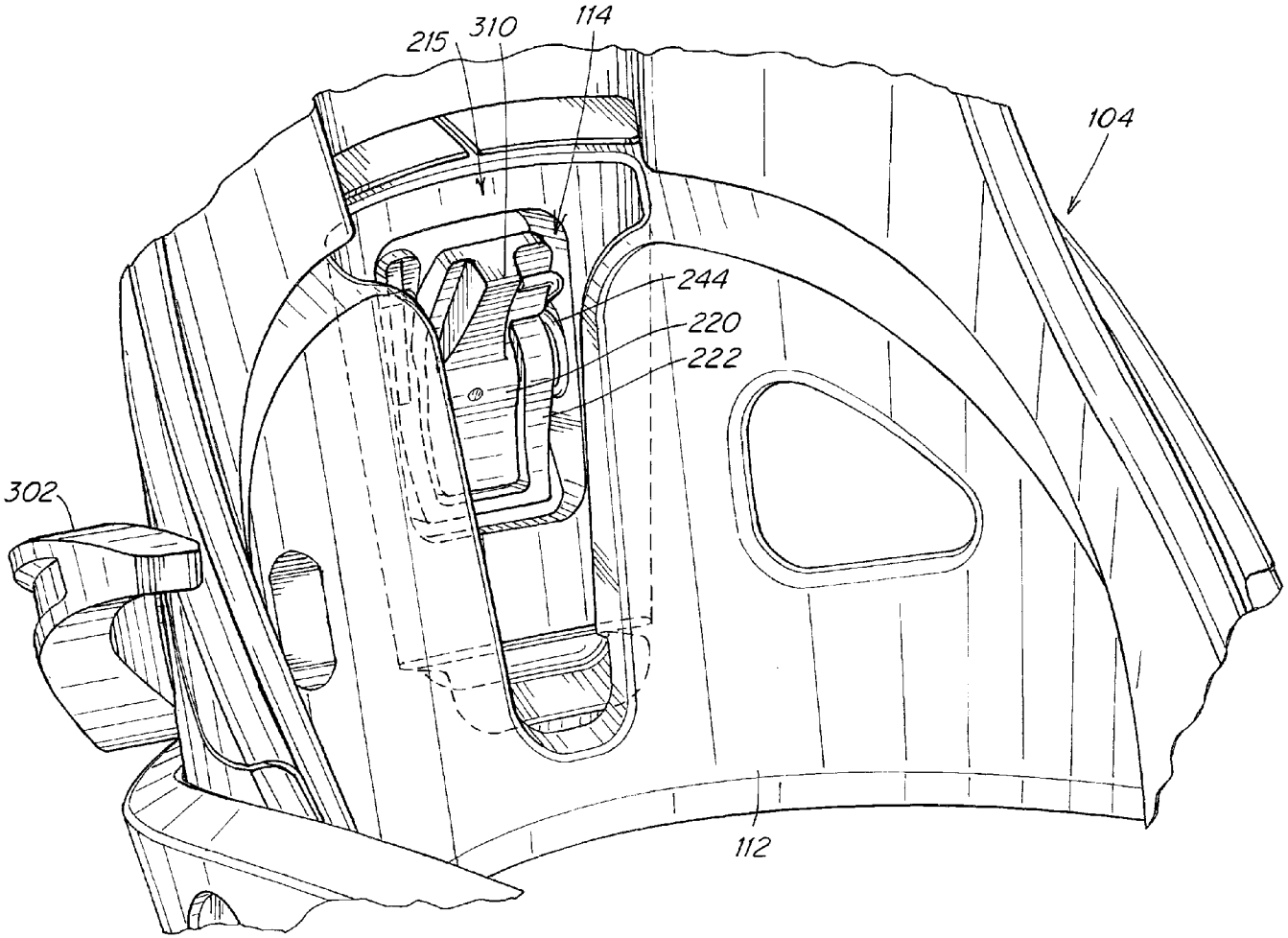
FIG. 14 shows the binding engagement member of FIG. 13 in a release configuration, according to one aspect.

The boot engagement member 108 may be removable from the boot in some embodiments. For example, as shown in FIGS. 10 and 11, boot engagement member 108 may include an attachment protrusion, such as a T-shaped protrusion 234, which is insertable into a recess 215 on the rear of the boot. The T-shaped protrusion has a neck 235 and a head 237 in some embodiments. Once inserted in the recess 215, the protrusion may be slid downwardly with the neck 235 moving through a T-shaped slot 216. Once the neck 235 reaches the bottom of the slot, a bolt 238, screw, or other fastener may be passed through a hole 239 in the boot engagement member 108 and engaged with a threaded hole 217 or nut within a hole or other fastener receiver in the boot. In some embodiments, only one fastener is used to removably attach the boot engagement member 108 to the boot. For example, only a bolt is used in some embodiments, or only the T-shaped protrusion is used in some embodiments. Other arrangements for removably attaching the boot engagement member 108 to the boot may be used. For example, the rear of the boot may have a protrusion which engages with a recess on the boot engagement member 108. In another example, the boot engagement member can snap fit into the boot, such as at the bottom of the slot.

Prevention of Upward Boot Movement

The boot engagement member may include engagement elements which secure the boot from movement in the upward direction when engaged with the corresponding binding engagement member 114. For example, as shown in FIG. 1, the boot engagement member includes a serrated surface 118 having one or more serrations in some embodiments, which interact with one or more pawls on the binding. A single serration may be provided in some embodiments, or multiple serrations may be provided. Other suitable engagement elements, or a single engagement element, may be used in some embodiments.

First and second pawls 220, 222 are included on the binding engagement member 114 in the embodiment shown in FIGS. 12-20 to engage with serrations 224*a*, 224*b*, and 224*c* on the boot engagement member 108 (see FIG. 15). Engagement surfaces 226, 228 of the two pawls are vertically separated from one another by approximately three millimeters, and a top surface 225*a*, 225*b*, and 225*c* of each serration is separated by approximately six millimeters from its adjacent serration top surface. With this arrangement, the binding can secure the boot engagement member at increments of three millimeters even though the serrations are separated by six millimeters.

Figure 16:
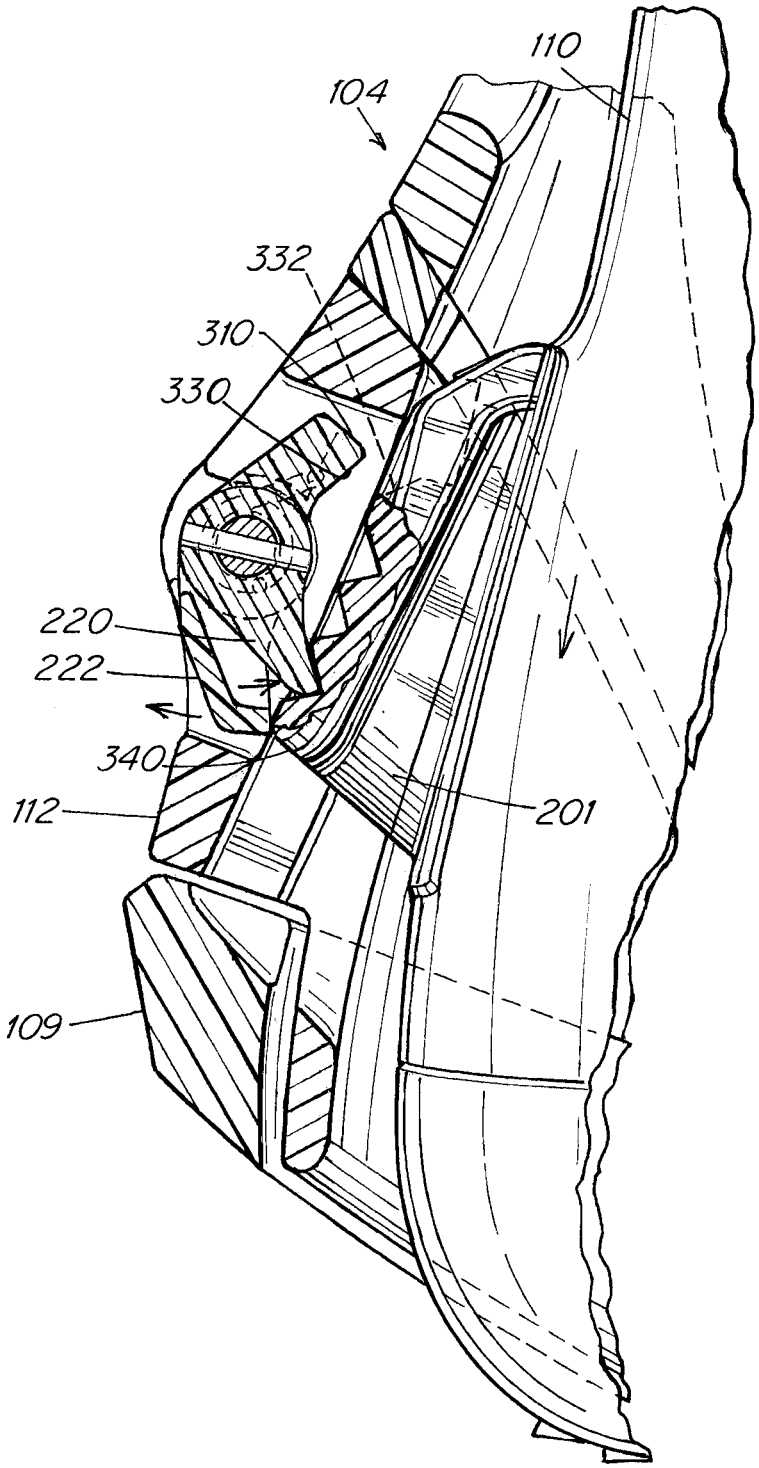
FIG. 16 is a partial cross-sectional side view of the boot engagement member engaged with the binding engagement member at a first position according to one aspect.

As the boot engagement member passes downwardly through the pawls 220, 222 in the direction of Arrow A in FIG. 15, the first pawl 220 passes over serration 224*c* such that serration 224*c* would be the serration to prevent upward movement of the boot through contact with first pawl 220 if the boot were to be in its final secured position at this point (e.g., see FIG. 16).

If the boot is pressed further downward, the second pawl passes over serration 224*c*, and the second pawl would be the pawl to contact serration 224*c* and secure the boot if the boot were to be in its final position. At this point, the second pawl is still three millimeters away from engaging with serration 224*b*. Once the boot reaches its final position, in this embodiment, only one pawl and serration engage to prevent upward movement in the illustrated embodiment. Such an arrangement permits engagement increments that are smaller than the serration separations. The smaller increments reduce the amount of possible up-down motion after the boot is engaged, or after snow or ice dissipates during use. The larger serration separations allow for selection from a wider variety of serration materials for the serrations and/or pawls. That is, the larger surface areas upon which the forces applied during riding help to reduce the contact pressure by distributing the forces, and thus materials that may otherwise yield under such forces may be employed. Also, by including multiple pawls and/or serrations, the binding system can accommodate snow, ice or debris buildup between the boot and the binding, though a single serration or other engagement feature may be used in some embodiments.

Figure 17:
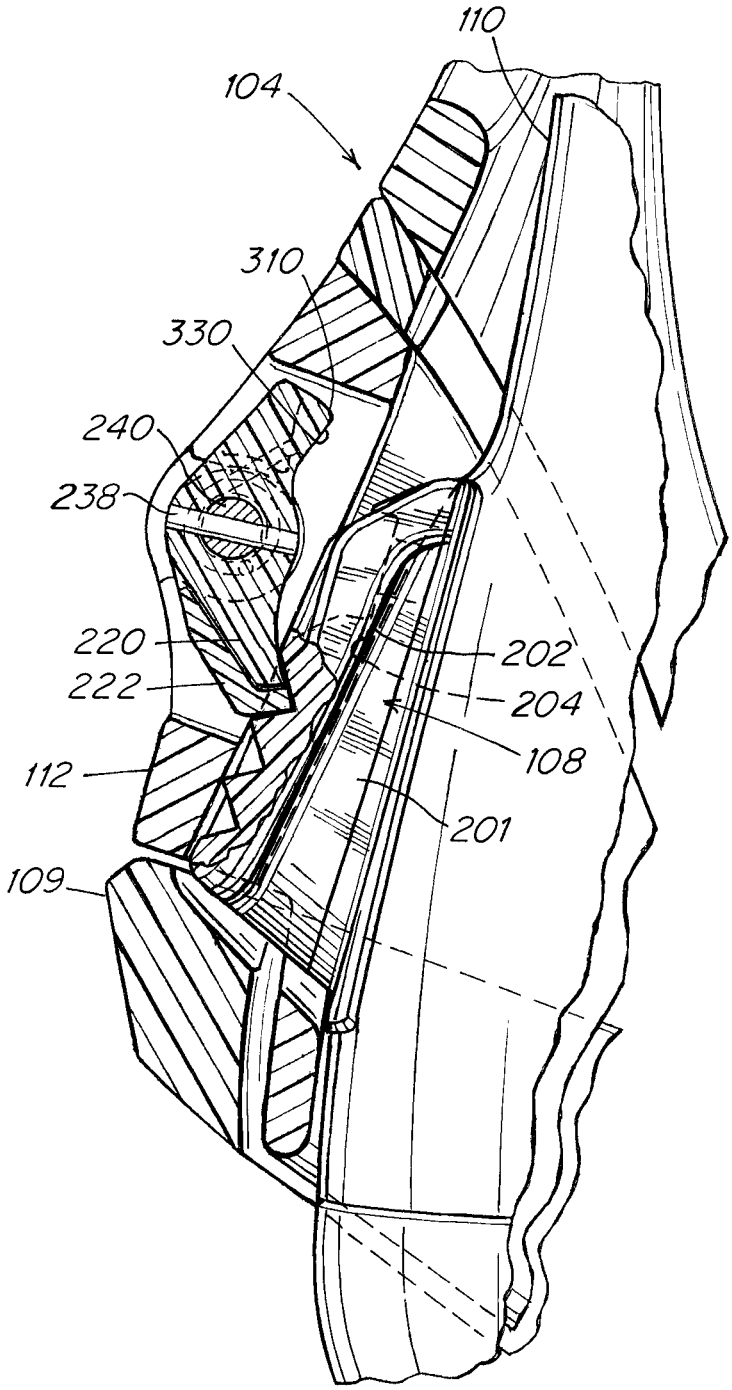
FIG. 17 is a partial cross-sectional side view of the boot engagement member engaged with the binding engagement member at a second position according to one aspect.

FIG. 17 shows second pawl 222 engaged with top engagement surface 225*a*, which represents the lowest secured position of the boot within the binding possible in the embodiment illustrated in FIG. 17. It should be appreciated that the binding engagement member may be constructed such that the first pawl 220 is engaged with top engagement surface 225*a*.

Figure 18:
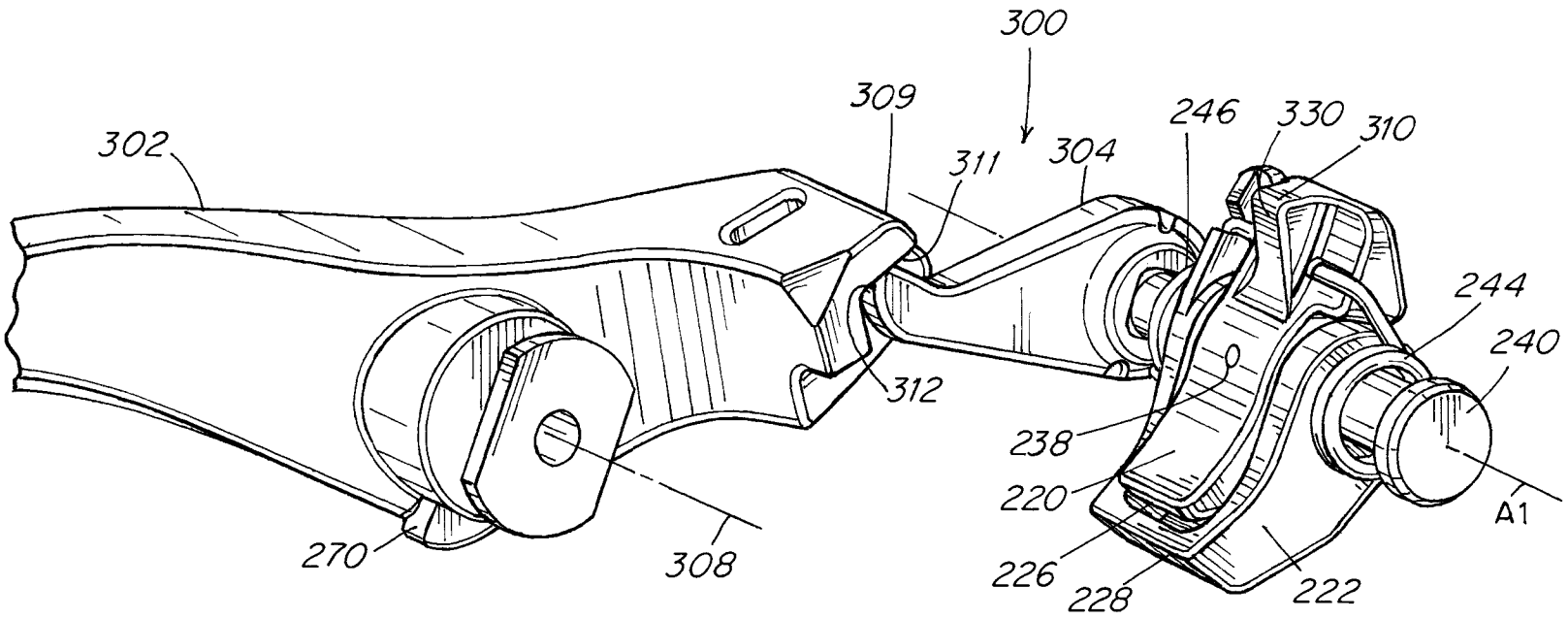
FIG. 18 shows various components of the binding engagement member and a release assembly according to one aspect.

In some embodiments, the rear binding engagement member includes nested pawls, where the pawls may share a pivot axis or have separate pivot axes. As shown in FIG. 18, first pawl 220 and second pawl 222 may share a pivot axis $A_1$. A transverse pin 238 connects a rotating pin 240 with the first pawl 220 so that rotation of the rotating pin 240 rotates the first pawl 220 and rotation of the first pawl rotates the rotating pin. First pawl 220 is rotationally biased toward an engaged position by a first torsion spring 244 or other suitable biasing element. Second pawl 222 is not rotationally locked to rotating pin 240 in this embodiment, but first pawl 220 and second pawl 222 are arranged such that rearward rotation of pawl 220 pushes against second pawl 222 to also rotate the second pawl rearward. Second pawl 222 is rotationally biased toward an engagement position by a second torsion spring 246 or other suitable biasing element.

The embodiment shown and described with reference to FIGS. 12-20 is not the only suitable implementation of nested pawls that is useable with the binding systems and methods disclosed herein. Other suitable implementations may be used.

In embodiments having two (or more) pawls, the pawls may be arranged in any suitable configuration. In the embodiment described above, the pawls are nested in the sense that one pawl (e.g., inner pawl) is housed or nested within another pawl (e.g., outer pawl). In one embodiment, the engaging surface of one pawl is positioned between the engaging surface and the pivot axis of the other pawl. Such a nested arrangement may permit the use of two pawls with one pawl engaging a single serration on the boot engaging member and the overall size or height of the pawl assembly is limited. In other embodiments, two pawls may be separated by such an extent that they are not nested, as will be explained below with respect to the embodiment of FIGS. 21-23. In still other embodiments, nested pawls may be employed where each pawl engages a separate serration.

In some embodiments with two or more pawls, the pawls are not offset to provide incremental engagement. Instead, two (or more) pawls may simultaneously engage separate serrations. In still other embodiments, two or more pawls may be separated laterally and engage separate serrations or separate areas of the same serrations. In some embodiments, a single pawl is used to engage with one or more corresponding serrations.

In alternative embodiments, one or more pawls may be attached to the rear of the boot, and one or more serrations may be positioned on the inside of highback or heel cup of the binding.

Release of Boot Heel

Boot 102 is shown secured to binding 104 in FIG. 2. To release the boot engagement member 108 from the binding 104 so that the boot can be removed from the binding, a release assembly 300 is provided. In the embodiment shown in FIGS. 18 and 19, the release assembly 300 includes a release handle 302 which rotates a release lever or actuator 304 to pivot pawls 220, 222 away from the serrations of the boot engagement member. With the pawls removed from the serrations, the boot engagement member is movable upwardly and out of the binding.

Figure 19:
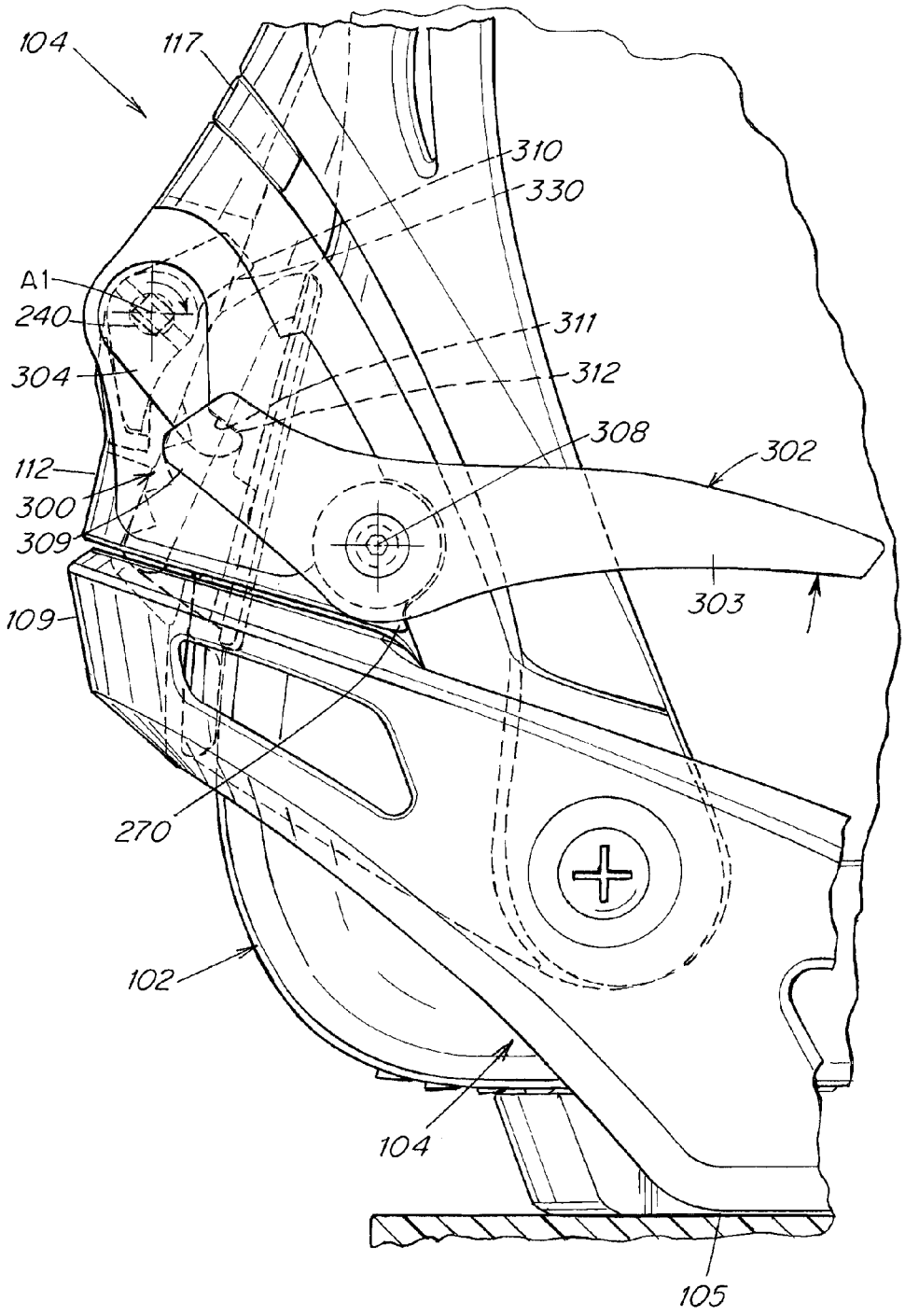
FIG. 19 is a side view of the release assembly according to one aspect.

From the viewpoint of FIG. 19, which is a view toward the lateral side of a right boot, a graspable portion 303 of the release handle 302 is pulled counterclockwise by the rider in the direction of arrow B around axis 308, which rotates an actuation portion 309 having a contact surface 311 counterclockwise. Contact surface 311 pushes against a contact surface 312 on the release actuator 304, rotating the release actuator 304 clockwise around axis A1. The release actuator is rotationally locked to rotating pin 240 (see FIG. 18), and thus rotates rotating pin 240 and first pawl 220. First, or inner, pawl 220 pushes outwardly against second, or outer, pawl 222, disengaging whichever pawl was engaged with a serration on the boot. A stop 270 is provided in the embodiment illustrated in FIG. 19 to limit the rotation of release handle 302.

Movement of the release handle 302 by the rider may include rotation and/or translation. In some embodiments, the release handle may be a sliding component or a pushable component, or any other suitable component actuatable by the rider. In some embodiments, a component such as release actuator 304 is the release handle. In another embodiment, a protrusion on the pawl (or pawls) can act as the release handle.

The release assembly may be arranged, in some embodiments, to remain in a release state after the rider lets go of the handle, such that the pawls are prevented from re-engaging with the serrations on the boot engagement member. For example, in the embodiment shown in FIG. 19, when the rider lets go of handle 302 after pulling the handle to release the boot, the pawls are spring-biased to rotate forward, back into engagement, and if the release actuator and handle do not provide enough resistance on their own to stop the pawl rotation, the pawls could rotate into an engagement position. Such an arrangement can result in undesirable re-engagement as the rider removes the boot from the binding. In some embodiments, the rider simply maintains the handle in the release position until the boot engagement member clears the pawls before letting go of the handle 302.

In other embodiments, the release handle 302 or another portion of the release assembly includes a detent or other arrangement which holds the pawl(s) in the release state even after the rider lets go of the handle. For example, handle 302 may include a rounded bump which engages with an indentation on heel cup 112. Once, the bump engages with the indentation, the detent arrangement resists the force provided by the springs of the spring-biased pawls, and prevents the pawls from rotating to engage the serrations.

The detent arrangement may be positioned elsewhere on the binding in some embodiments. Also, it should be appreciated that other mechanisms may be implemented to hold the pawls in the release state. The detent, or other arrangement, may be used to hold a binding engagement member which is different than a pawl configuration in a release state according to some embodiments.

Holding the pawls or other engagement member in the release state (e.g., by using the detent arrangement) aids in removal of the boot from the binding, but can leave the binding in a configuration where the pawls or other binding engagement member are not set to engage the boot when the rider inserts the boot at a later time. After removal, a rider may prefer to have the binding set to receive and engage his or her boot without requiring any rider manipulation of the binding. In some embodiments, after release of the boot engagement member, removal of the boot from the binding resets the pawls and the release assembly such that the binding is set to receive and engage the boot.

Figure 20:
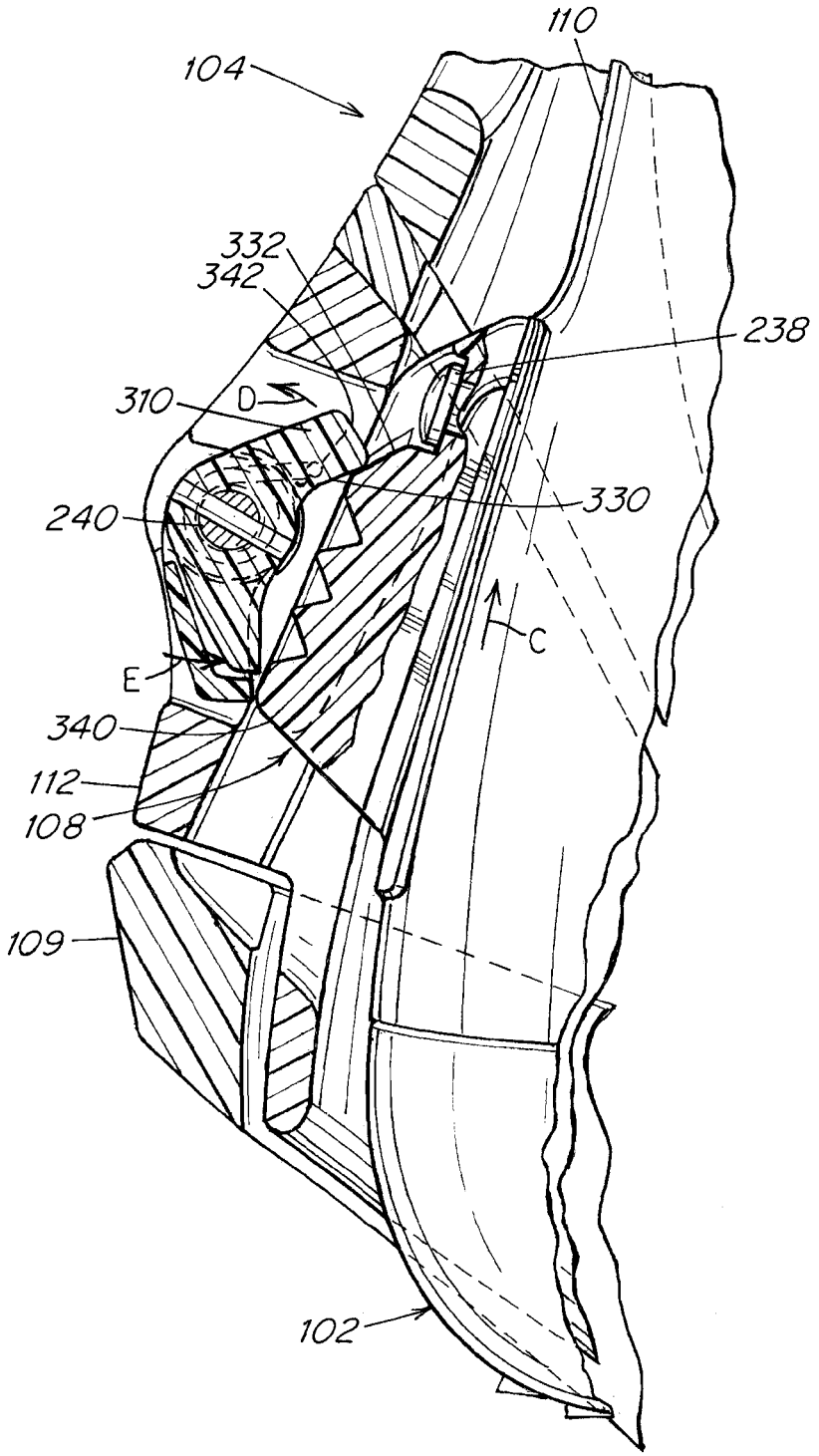
FIG. 20 shows a reset protrusion being contacted as the boot is being removed from the binding according to one aspect.

To reset the binding, a reset surface such as a reset protrusion 310 may be positioned along the path of boot removal, as shown in FIG. 20. As the boot engagement member 108 travels in upward (see arrow C), an upper sloped surface 332 of the boot engagement member strikes a surface 330 of the reset protrusion 310, rotating the reset protrusion in the direction of arrow D. The resulting force rotates the first pawl 220 in an engagement direction (clockwise in FIG. 20—see arrow E) which rotates the rotating pin 240, and in turn rotates release actuator 304. Release actuator 304 rotates the release handle via contact of contact surfaces 311 and 312 in a direction opposite to arrow B in FIG. 19 with enough force to disengage or uncouple the detent arrangement. With the detent arrangement disengaged, the pawl arrangement is set to receive and engage the boot engagement member the next time the rider steps into the binding.

While the boot is removed from the binding, if the release handle 302 is pulled and then held in place by a detent arrangement (or otherwise), thereby putting the pawls in a released configuration, downward movement of the boot into the binding may reset the pawls into an engaged configuration in some embodiments. For example, a bottom surface 340 of boot engagement member 108 may strike an upper sloped surface 342 when the boot engagement member 108 is being inserted into binding engagement member 114. This contact rotates the first pawl 220 in an engagement direction and overcomes the resistance of the detent arrangement to place the binding in a state where the boot engagement member 108 can engage with the binding engagement member 114 in some embodiments.

The pawl release assembly may be configured to allow movement of the pawls as the boot is inserted into the binding without resulting in movement of the release handle 302. For example, in the embodiment shown in FIGS. 18 and 19, while release actuator 304 contacts handle 302, the two elements are not attached. Consequently, as the serrations of boot engagement member 108 rotate the pawls rearwardly during boot insertion, which rotates rotating pin 240 and release actuator 304, the release actuator moves away from release handle 302 and has no effect on the release handle.

Additionally, by not attaching release actuator 304 to release handle 302 the handle and its associated friction do not affect the biasing of the pawls. But when the release actuator 304 rotates in the other direction, for example when the reset protrusion is contacted by the boot engagement member during removal of the boot, the release actuator is able to act on the handle to disengage the detent arrangement.

The release actuator 304 and handle 302 arrangement moves the location of rider actuation away from a rear of the boot to the side of the boot along the mid-foot region. This repositioning moves the rider actuation location away from the pant leg region to provide convenient access to the actuation location. In one embodiment, the release handle is curved to follow or wrap around the curved shape of the heel cup, such that the graspable portion of the handle is at the side of the binding and the actuation portion of the release arrangement is located at the rear near the centerline or center region of the binding. In one embodiment, the handle may be a single unitary construct such that the graspable portion and the actuation portion are formed on the same monolithic structure. In other embodiments, not shown, the handle may be formed of multiple components that together cooperate to wrap around the heel cup as explained above.

Other arrangements of release assemblies may be used, an example of which will be described next with respect to the embodiment shown in FIGS. 21-23, and such a release assembly described with respect to the FIGS. 21-23 embodiment may be employed in the above embodiments. Another alternative embodiment of a release assembly is described further below with references to FIGS. 37-40, and this alternative release assembly embodiment may be used with the embodiments described above.

Figure 21:
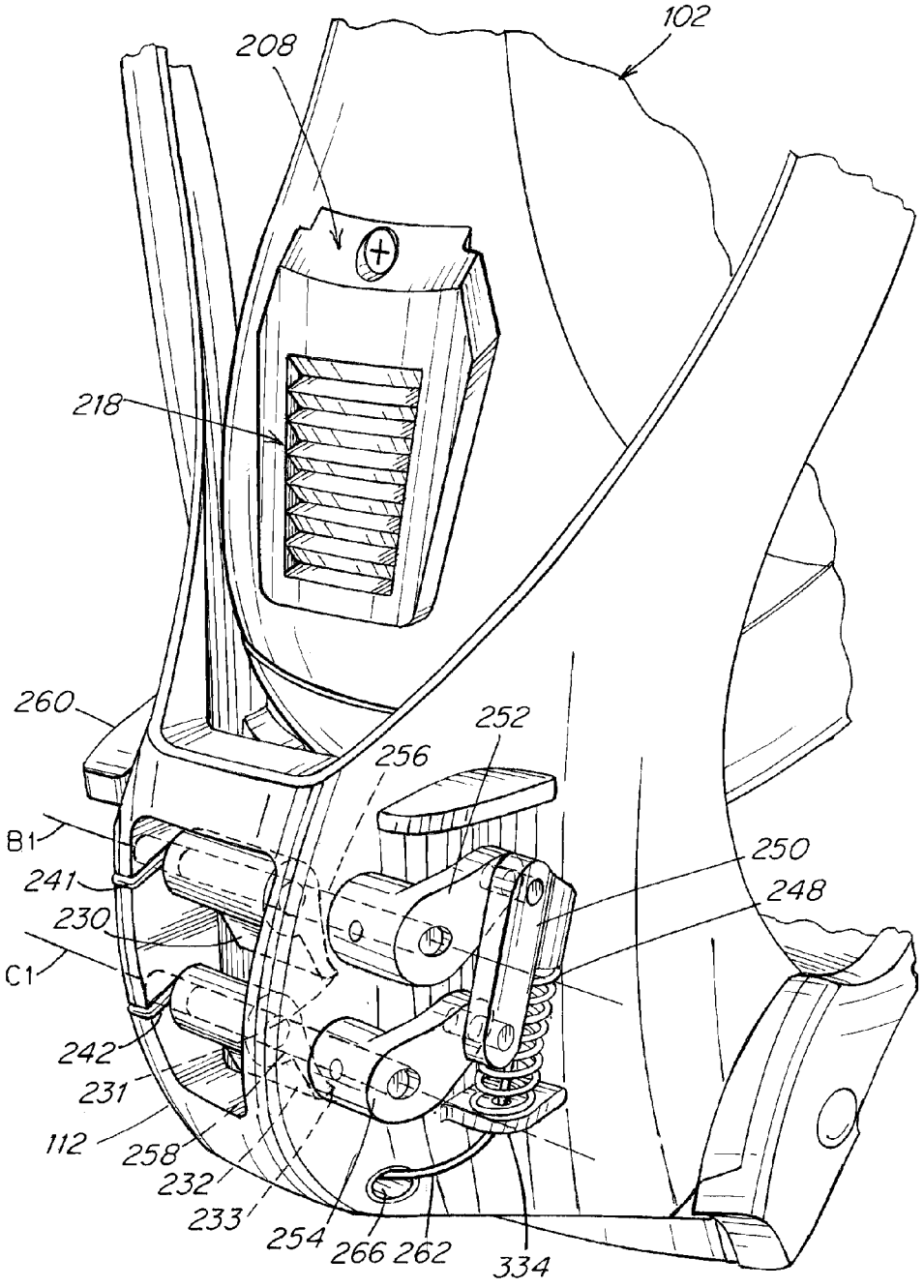
FIG. 21 shows an alternative embodiment of a binding engagement member according to one aspect.

Turning now to such an alternative embodiment of the rear binding engagement arrangement, as shown in FIG. 21, a first pawl 230 is mounted for rotation about an axis $B_1$, and a second pawl 232 is mounted for rotation about an axis $C_1$. The first pawl 230 has a first engagement surface 231, and the second pawl 232 has a second engagement surface 233 to engage serrations 218 on a boot engagement member 208 attached to the boot.

Figure 22:
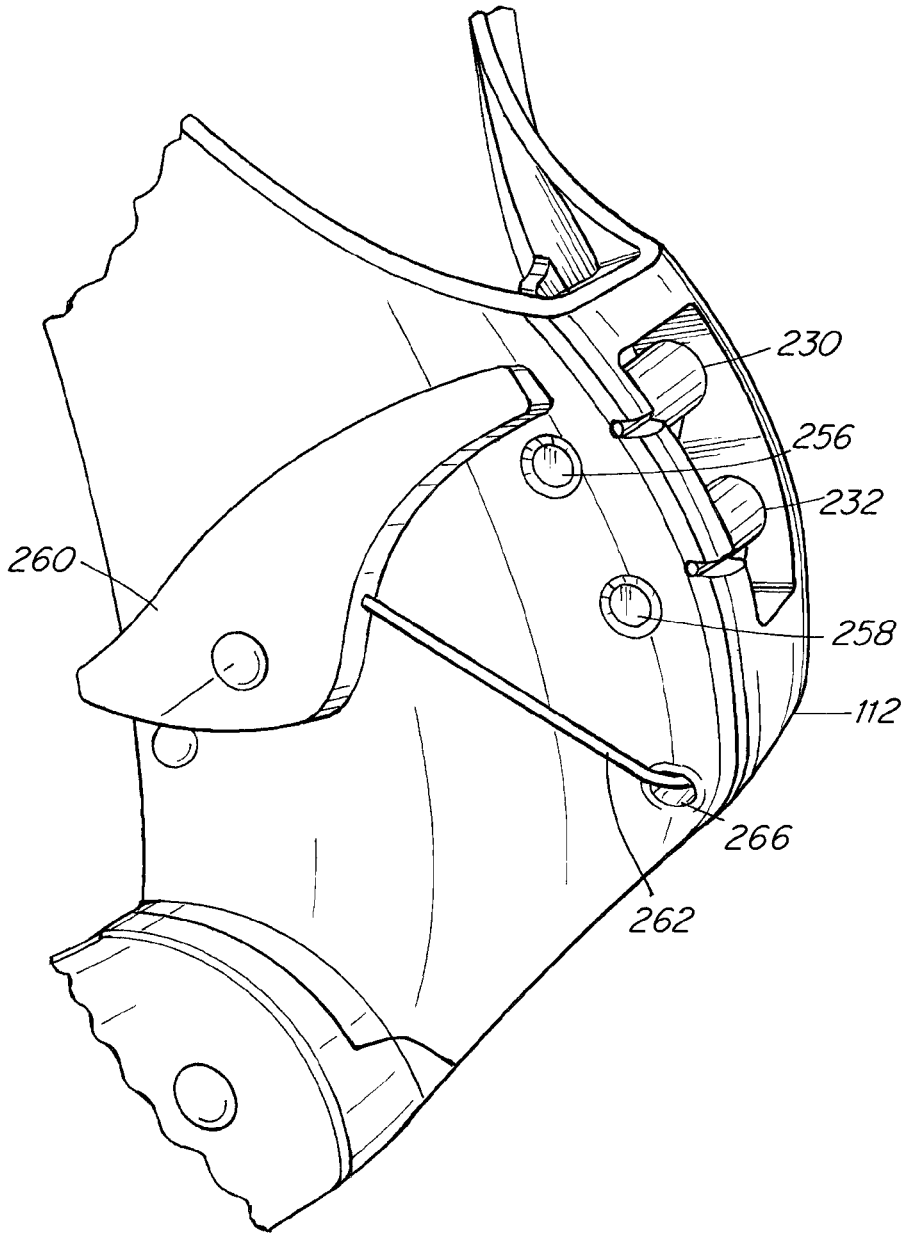
FIG. 22 shows an alternative embodiment of a binding engagement member release assembly according to one aspect.
Figure 23:
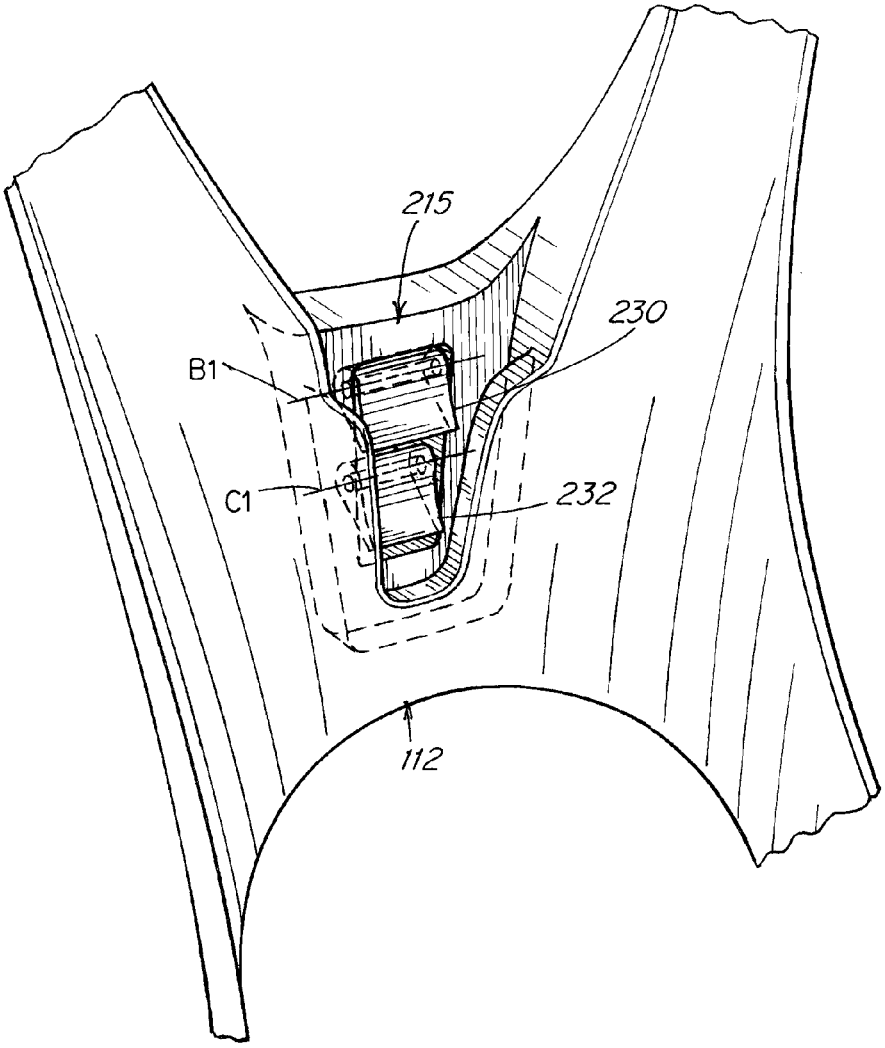
FIG. 23 shows the binding engagement member of FIG. 22 from the boot-facing side of the binding, according to one aspect.
Figure 24:
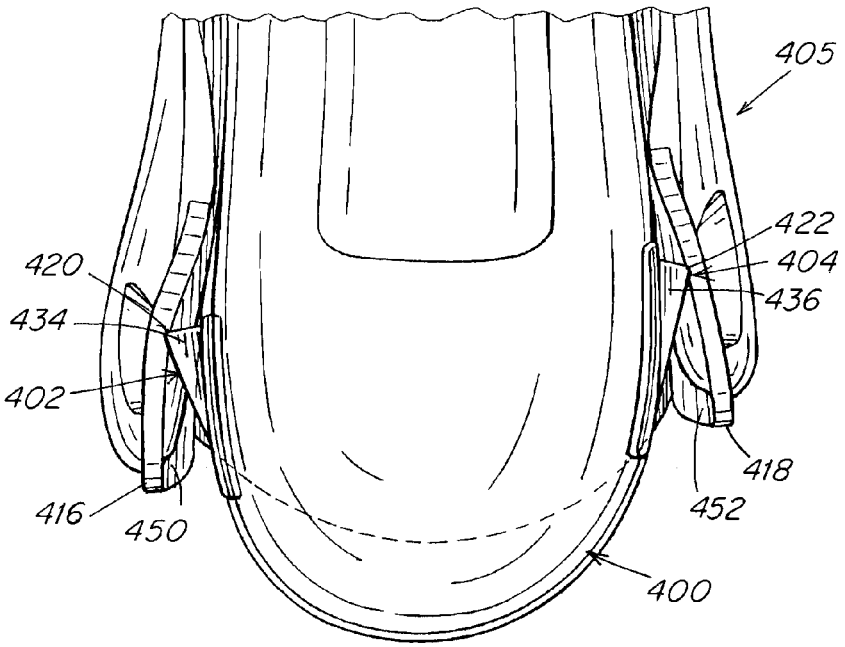
FIG. 24 is a top view of a toe region of a boot about to be engaged with a binding according to one aspect.

In the embodiment shown in FIGS. 21-23, the pawls 230, 232 are biased by a coil spring 248 which pushes on a linkage bar 250 to rotate two arms 252, 254, which in turn rotate two rotating pins 256, 258 on which the pawls are mounted. The coil spring is supported by a shelf 334 which extends outwardly from the heel cup. Each pawl is also biased toward an engagement position by a respective torsion spring 241, 242, though any suitable method of biasing the pawls, or combination of methods of biasing the pawls, may be used.

In this embodiment, first pawl 230 is positioned higher than a second pawl 232. Unlike the embodiment described above, in this embodiment, the pawls 230 and 232 are not nested; however, they may be positioned such that they provide offset incremental engagement similar to the embodiment shown in FIG. 13. That is, the serrations may be positioned such that when a first serration can engage with the first pawl 230, the second pawl 232 is half the distance to a nearest serration. When the first serration reaches a position where the first serration can engage with the second pawl 232, the first pawl 230 is half the distance to a nearest serration. In some embodiments, including variations of the embodiments described herein, the increments do not necessarily have to be half the distance between the serrations.

To release the pawls from the boot engagement member, a release handle 260 is attached to a release a cord 262. Pulling the release handle upwardly pulls the cord 262, which pulls downwardly on linkage bar 250. The downward movement of the linkage bar 250 rotates the two arms 252, 254 about axes $B_1$ and $C_1$, respectively, to release the first and/or second engagement surfaces 231, 233 from the serration(s) on the boot. The cord may pass through a passage 266 in the highback.

In other embodiments, a pressing surface may extend directly from an upper region of the second pawl 220 such that when the rider presses on the surface, the second pawl 220 pivots away from the serrations, and pushes the first pawl 222 away as well.

Boot Toe Engagement

To secure the mid-region and/or toe region of the boot to the binding such that these regions cannot be lifted upwardly when the boot heel is attached to the binding, a step-in arrangement is provided in some embodiments. According to one aspect, the boot may be provided with one or more protrusions or other features which move a component of the binding as the boot is inserted into the binding.

For example, as shown in FIGS. 24-28, a left boot 400 has a first, medial protrusion 402 extending outwardly from the side of the boot, and a second, lateral protrusion 404, also extending outwardly from the side of the boot. Each protrusion includes a lower surface 406, 408 angled upwardly relative to snowboard, as shown in the front view of FIG. 25.

Figure 25:
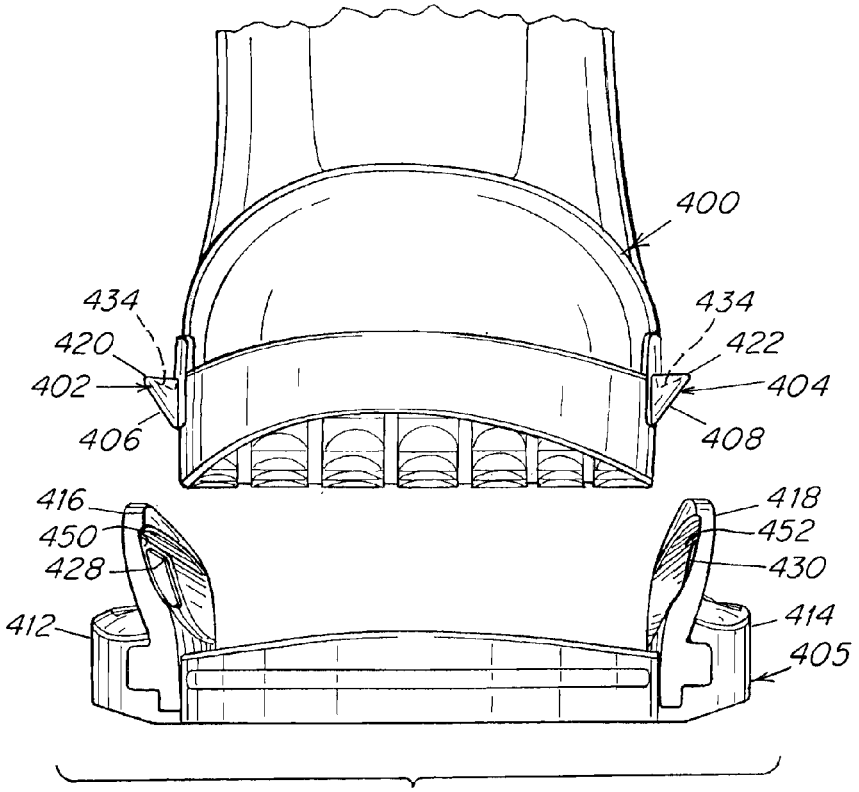
FIG. 25 is a front view of the boot of FIG. 24 about to be engaged with a binding according to one aspect.
Figure 26:
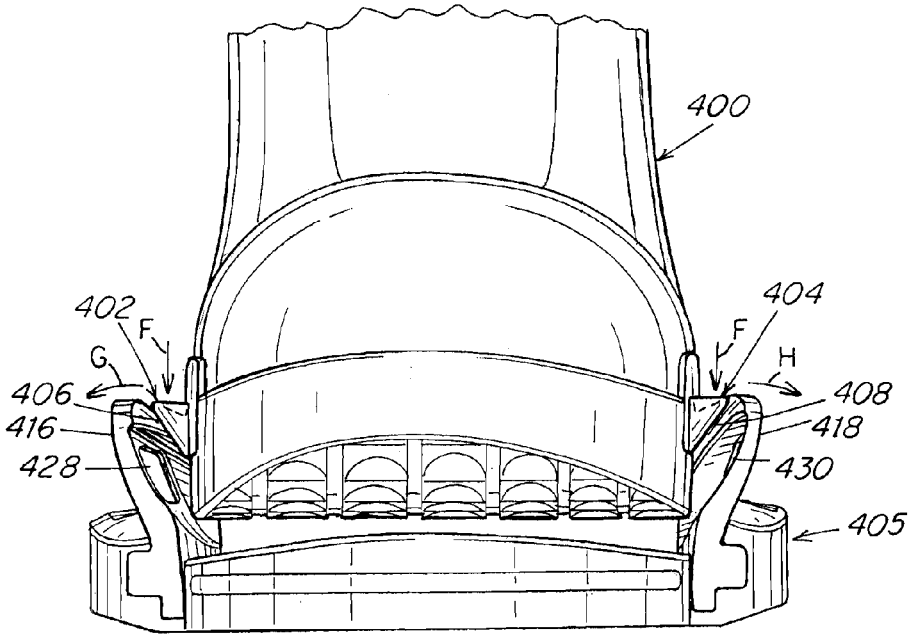
FIG. 26 is a front view of the boot of FIG. 25 being pressed downwardly into the binding of FIG. 25 according to one aspect.

FIG. 25 also includes a front view of a binding 405 that has a medial sidewall 412 and a lateral sidewall 414. Each sidewall has an engagement feature such as a catch 416, 418 extending upwardly from a respective sidewall. As the boot is pushed downwardly in the direction of arrow F, each lower surface 406, 408 of the protrusions 402, 404 contacts a top surface of catch 416, 418, and each lower surface pushes outwardly on a respective catch, splaying the catches 416, 418 apart from each other in the directions of arrows G and H, as shown in FIG. 26. That is, the lower surfaces 406, 408 act as camming surfaces to push the catches outward away from the centerline of the binding. The protrusions force the catches far enough apart to allow the distal ends 420, 422 of the protrusions to pass by tops of the catches and reach engagement portions such as recesses or openings 428, 430. The lower surfaces 406, 408 may be curved either convexly or concavely or may be planar having any suitable camming angle that can aid in splaying the catches outwardly.

Figure 27:
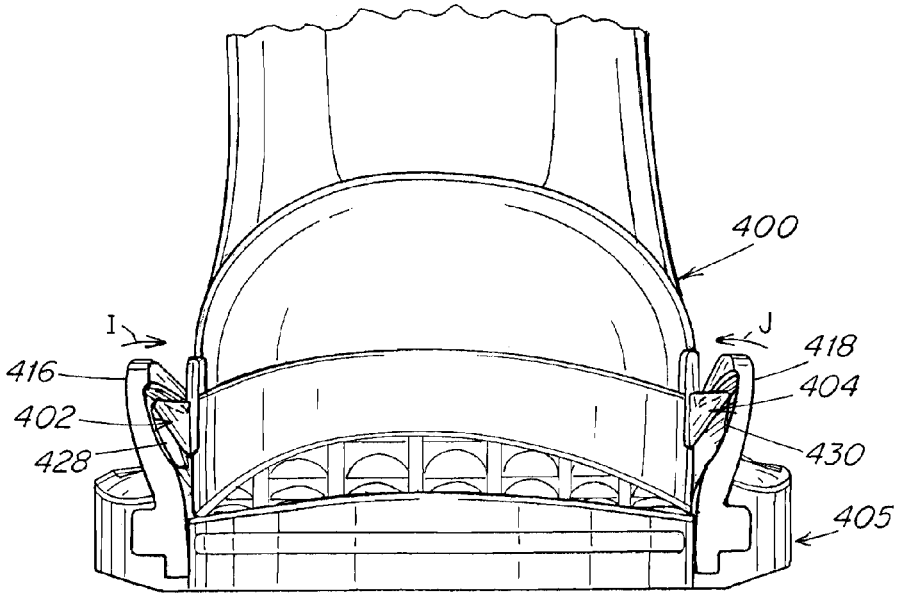
FIG. 27 is a front view of the boot of FIG. 25 engaged with the binding according to one aspect.
Figure 28:
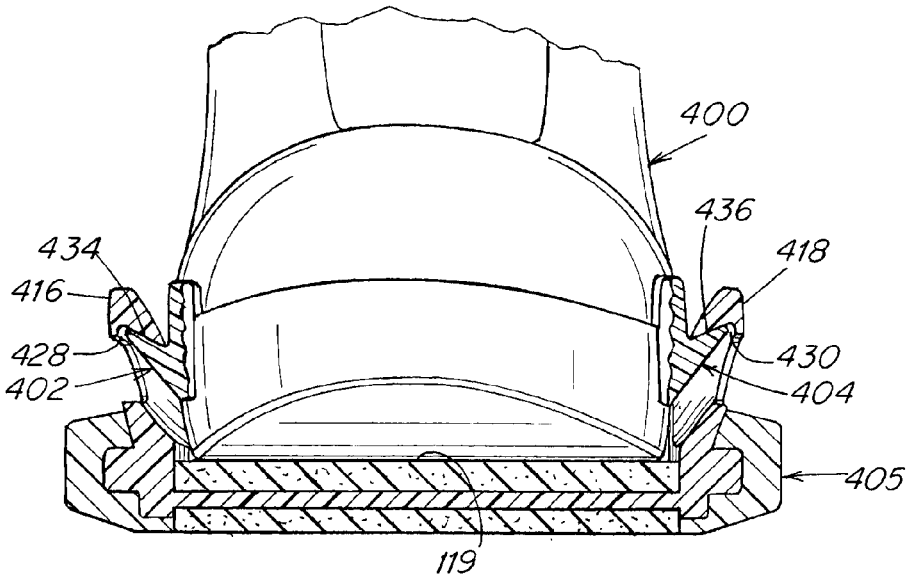
FIG. 28 is a cross section of the boot of FIG. 25 engaged with the binding according to one aspect.

When the distal ends 420, 422 reach the engagement portions, the catches 416, 418 return inwardly in the directions of arrows I and J, and capture the protrusions 402, 404 such that upward movement of the protrusions is prevented, as shown in FIG. 27. In this manner, a rider can secure the toe region of the boot against upward movement simply by stepping into the binding. FIG. 28 shows a cross section of the protrusions on the boot and the catches on the binding. As shown, each catch may have a hook-shaped profile and each protrusion may have a correspondingly-shaped sloped upper surface 434, 436. In this manner, the likelihood of the catch becoming disengaged from the protrusion is limited.

Figure 29:
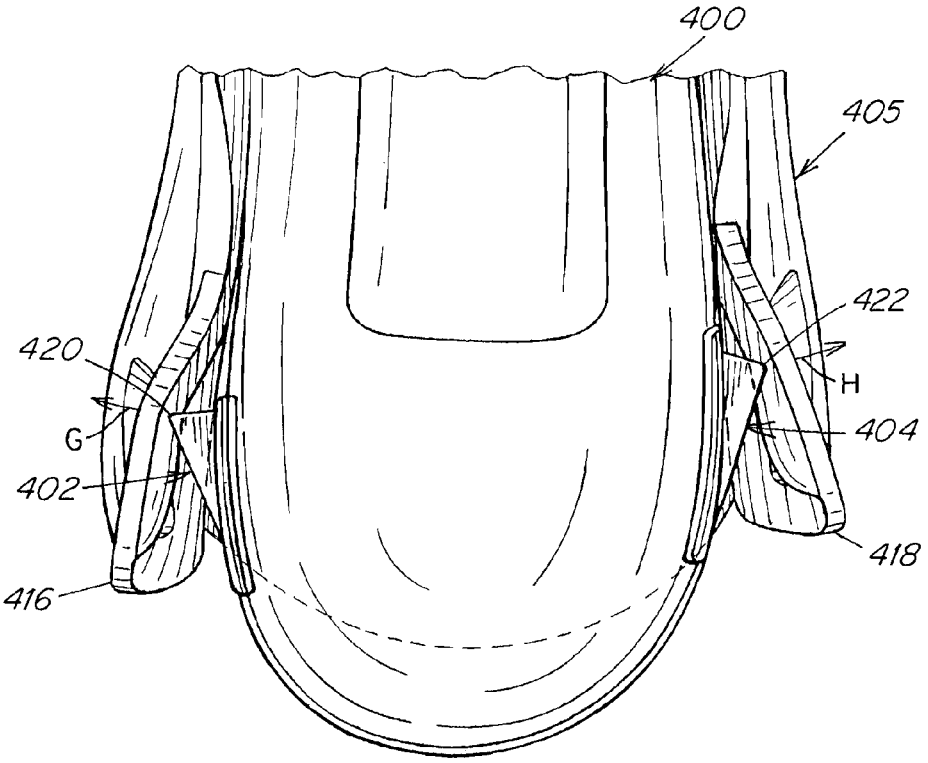
FIG. 29 is a top view of the boot of FIG. 25 being pressed downwardly into the binding of FIG. 25 according to one aspect.
Figure 30:
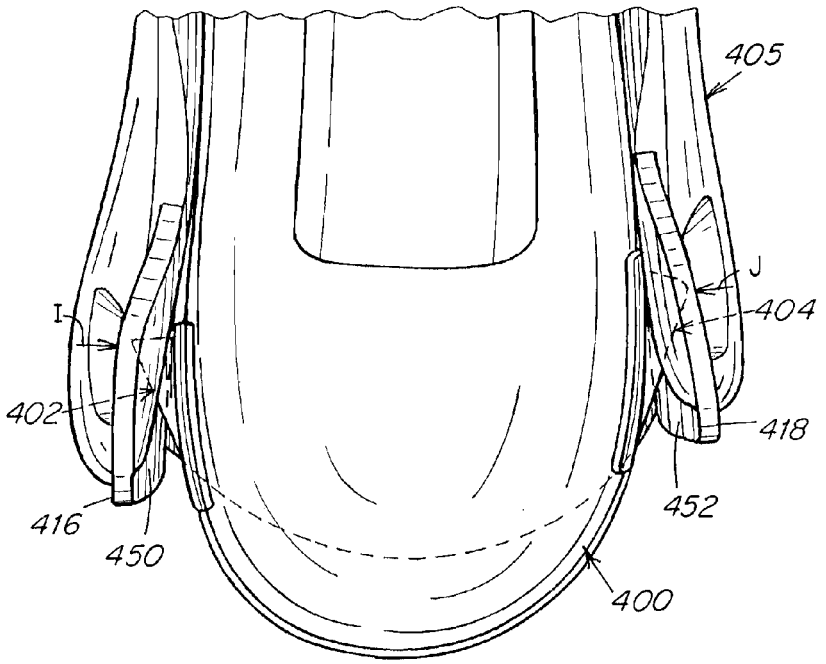
FIG. 30 is a top view of the boot of FIG. 25 engaged with the binding according to one aspect.
Figure 31:
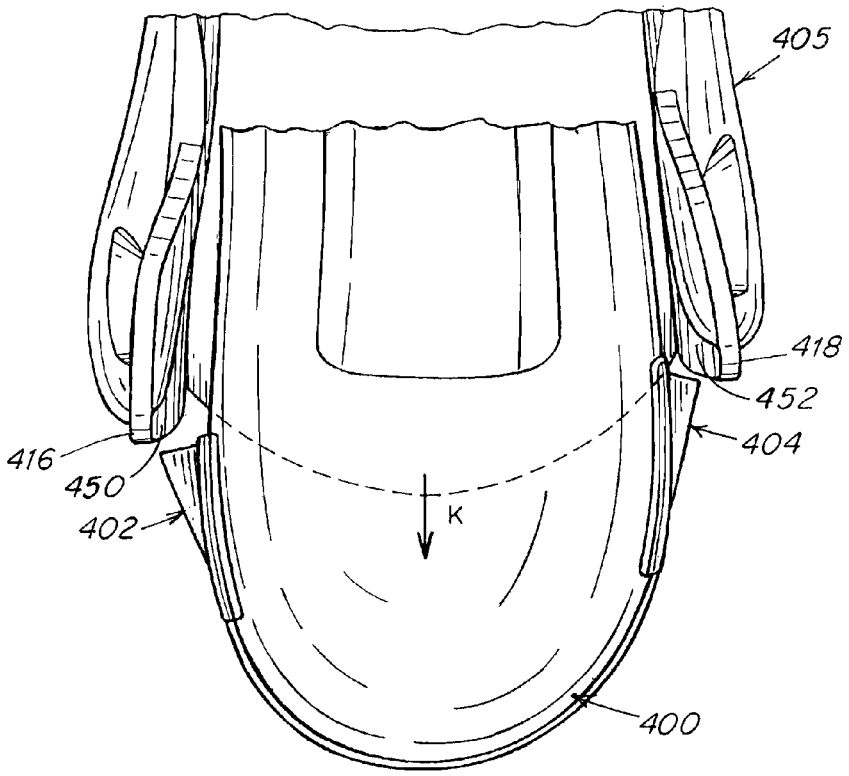
FIG. 31 is a top view of the boot of FIG. 25 removed from the binding according to one aspect.

FIG. 29 is a top view of protrusions 402, 404 separating catches 416, 418 as the boot is pushed into the binding. FIG. 30 shows catches 416, 418 rebounding inwardly to capture protrusions 402, 404.

Figure 32:
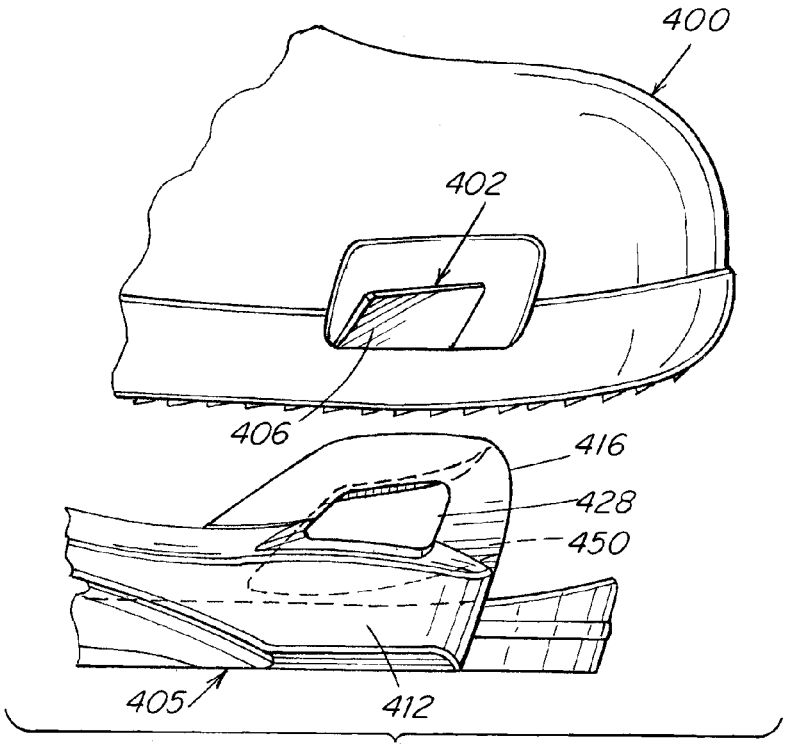
FIG. 32 is a side view of the boot of FIG. 25 about to be engaged with the binding according to one aspect.
Figure 33:
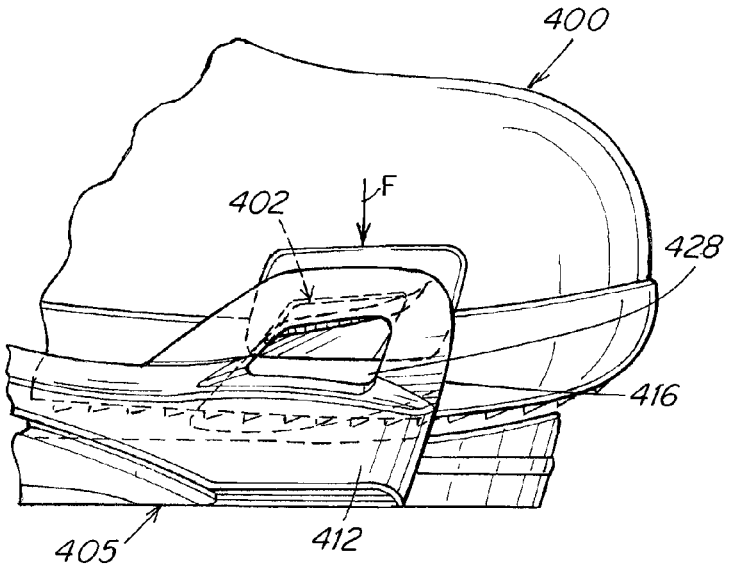
FIG. 33 is a side view of the boot of FIG. 25 being pressed downwardly into the binding of FIG. 25 according to one aspect.
Figure 34:
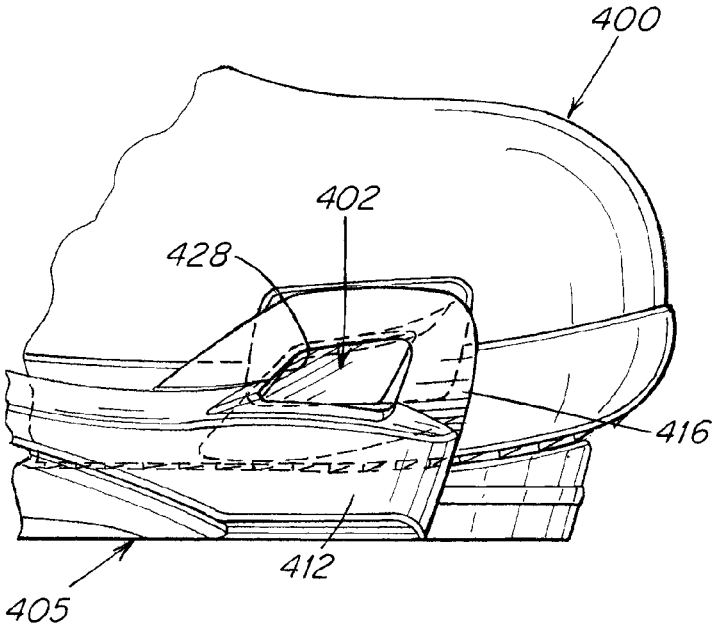
FIG. 34 is a side view of the boot of FIG. 25 engaged with the binding according to one aspect.
Figure 35:
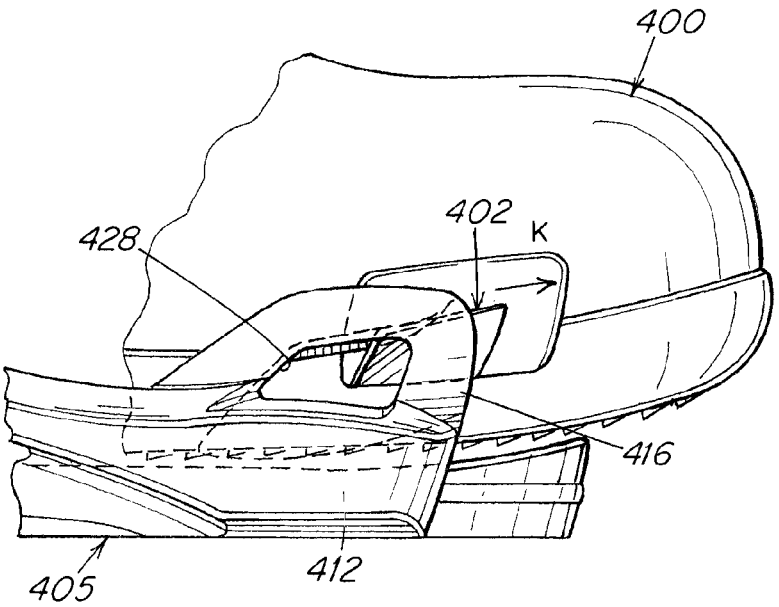
FIG. 35 is a side view of the boot of FIG. 25 being removed from the binding according to one aspect.

Side views of the insertion sequence of boot 400 into binding 405 are shown in FIGS. 32-34.

In alternative embodiments, only one side of the binding has a protrusion and catch arrangement where the protrusion moves the catch outwardly during boot insertion. A catch may be located on the boot in some embodiments, with a corresponding protrusion positioned on the binding. In some embodiments, the protrusions may be attached to the boot via an interface that is attached to the boot. For example, an arrangement of straps may encircle the toe region of the boot and have protrusions extending therefrom.

A rider-actuated engagement arrangement may be employed in some embodiments. For example, a latch or sliding pin may be used to secure the toe region of the boot against upward movement, and require the user to open the pin or latch to insert the boot, and/or close the pin or latch to capture the boot once inserted.

The boot toe and mid-region attachment arrangements described above may be used to secure the heel section of a boot in some embodiments.

Further, in one embodiment, the catches may include a rotating, spring-biased pawl. The spring bias can be provided by a separate spring or a living hinge arrangement. As the toe region is stepped into the binding, rather than the sidewalls to splaying outward as described above, the pawls simply rotate out of the way against the spring bias. Once the boot is sufficiently in position, the pawls can rotate inward under the influence of the spring to engage the boot. It should be appreciated that the location of the components could be reversed, such that the boot includes a rotating pawl that can engage with a suitable engagement feature on the binding.

Boot Toe Removal

To permit removal of the toe region of the boot from the binding, the catches may include channels 450, 452 with openings at the forward ends of the catches, as best seen in FIGS. 30-32, and 35. When the boot heel is released from the binding (e.g., sliding the boot engagement member out of the binding engagement member), the boot can be moved forwardly by the rider in the direction of arrow K. The protrusions travel along the channels until reaching the forward end openings, at which point the boot is free of the binding. In some embodiments, the boot may be pitched forward as the boot is being moved forward to remove the boot from the binding.

The channel may be short in some embodiments, wherein the engagement region of the catch is immediately adjacent the forward opening. Or, the channel may extend several centimeters in some embodiments from the engagement region to the opening. The channel is not necessarily a straight line, nor does it necessarily have a path that is parallel to the snowboard when mounted to the snowboard. For example, the channel may be downwardly angled, upwardly angled, or a combination thereof.

The toe region engagement and/or removal arrangement described herein may be used with the heel engagement embodiments described herein. In some embodiments, however, the toe region engagement and/or removal arrangement may be used with other heel engagement structures and/or other boot engagement structures.

In some embodiments, the toe region is inserted into the binding by moving the boot rearwardly through the forward opening in the channels and into the engagement region. That is, a snap-in arrangement is not employed in some embodiments.

Toe Catch Assembly Component

Figure 36:
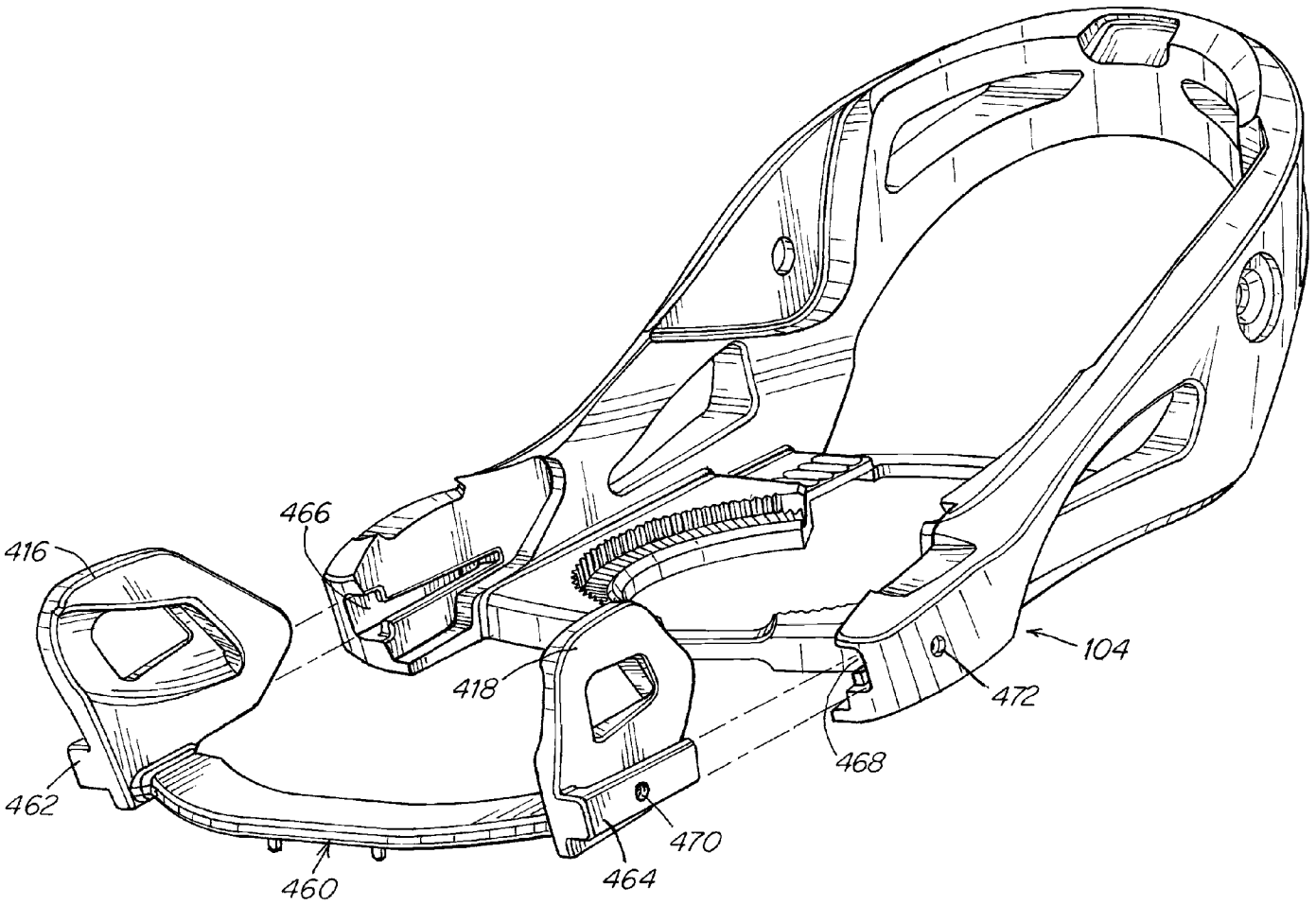
FIG. 36 shows a toe catch assembly separated from the binding according to one aspect.
Figure 37:
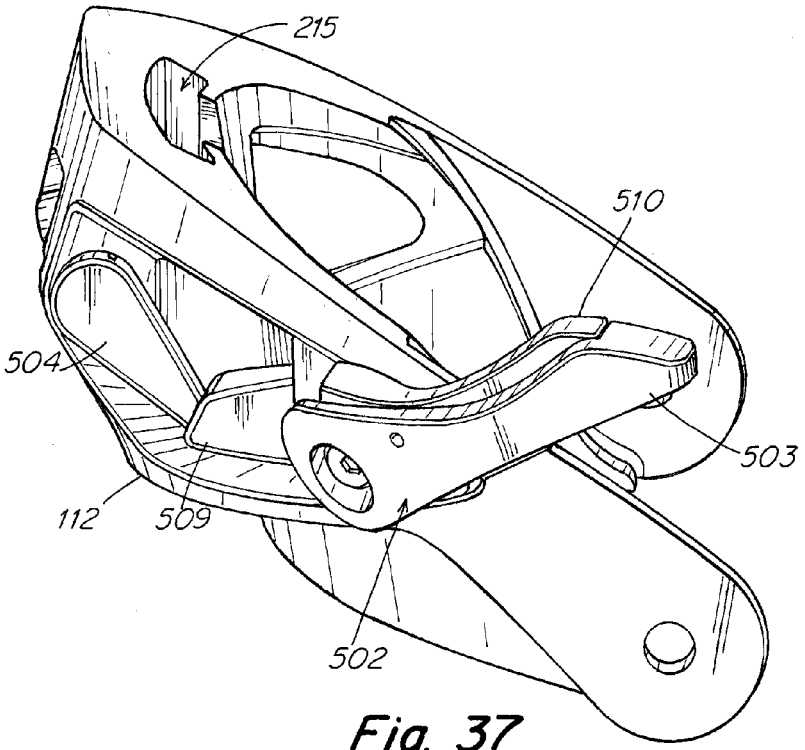
FIG. 37 is a perspective view of an alternative embodiment of a release assembly.
Figure 38:
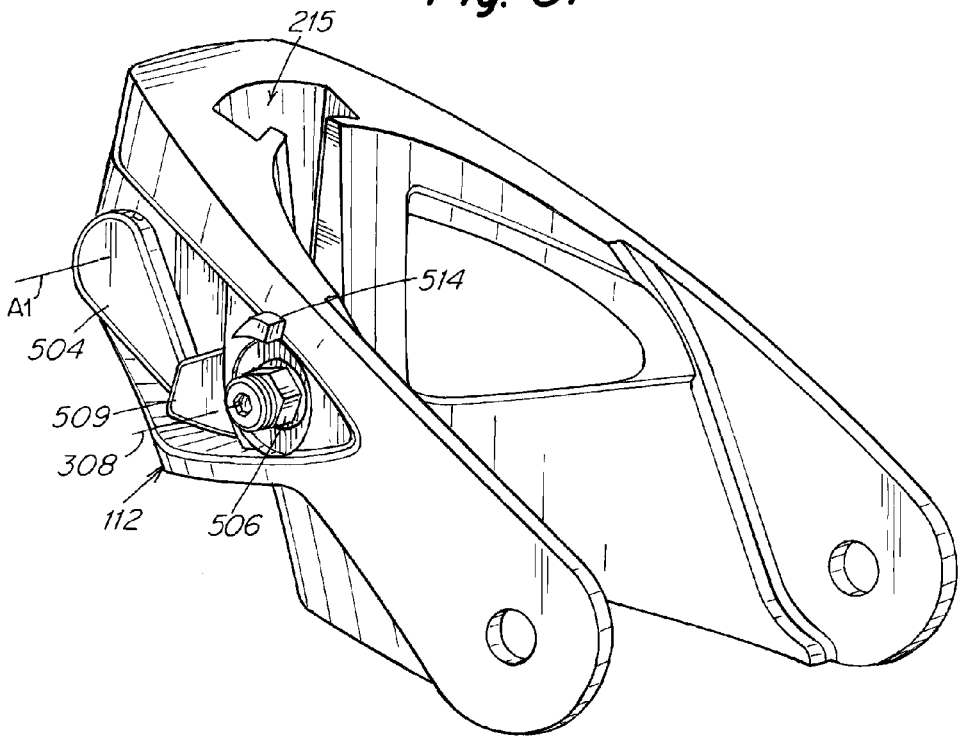
FIG. 38 shows the embodiment of FIG. 37 with a graspable portion of a release handle removed.

While in some embodiments, catches 416, 418 may be formed integrally with the binding, for example, as part of the sidewalls, in other embodiments, the catches 416, 418 may be made separately from the binding and then attached to the binding. For example, as illustrated in FIG. 36, a toe catch assembly 460 is made of a separate piece of material and attachable to the binding 104. Each side of the toe catch assembly 460 includes an elongated protrusion 462, 464 which is insertable into a corresponding channel 466, 468.

The elongated protrusions may include a screw hole 470 which aligns with a corresponding screw hole 472 in the binding to permit attachment of the toe catch assembly 460 to the binding. In some embodiments, the attached position of the toe catch assembly may be adjustable. For example, instead of a single screw hole, the binding and/or the toe catch assembly may include multiple screw holes to allow for selection of a particular toe catch assembly position. In other embodiments, the channel in the binding may have an elongated slot instead of a screw hole, such that the screw hole of the toe catch assembly can be positioned anywhere along the elongated slot and then secured to the binding. Alternatively, the protrusion 464 may be provided with an elongated slot such the screw hold on the binding can be positioned anywhere along the length of the elongated slot in the protrusion and secured to the toe catch assembly. In some embodiments, the attachment of the toe catch assembly to the binding is a permanent attachment, while in other embodiments, the toe catch assembly is removable from the binding, repositionable, and re-attachable.

In embodiments where the relative positioning of the toe catch assembly and the binding base is adjustable, the boot may be provided with protrusions that are adjustable along the length of the boot. For example, in some embodiments, the protrusions may be attached to an interface which is attachable to the boot at different positions. The interface may include straps that wrap around the toe region of the boot. In other embodiments, the protrusions may be formed in channels along the sides of the boot in a manner such that the protrusions may be moved to and secured at various positions in the lengthwise direction.

The toe catch assembly may be formed of a different material as compared to the binding base in some embodiments. For example, the toe catch assembly may be made with polycarbonate while the binding base may be made with glass-filled nylon. Though, any suitable material(s) or combination of materials may be used in the toe catch assembly and the binding.

Boot Construction

The boot 400 shown in FIGS. 24-35 is configured for the left foot of a wearer, and comprises a medial side and a lateral side. Herein, the term "lateral side" is used to refer to the side of a boot facing outward and away from the wearer, i.e., the left side of the left boot and the right side of the right boot, when worn by the wearer. The term "medial side" is used to refer to the side of a boot facing inward toward the wearer's other foot, i.e., the right side of the left boot and the left side of the right boot, when worn by the wearer.

The boots described herein may be configured as a soft boot employing soft, flexible materials such as leather, fabrics, plastics (e.g., non-rigid plastics) or other suitable natural or manmade materials.

The boot may be formed such that the protrusions in the toe region and/or the rear boot engagement member may be attachable to the boot, or these components may be formed integrally with the boot. For example, the protrusions and/or boot engagement member may be molded as part of the boot. The components may be stitched or glued to the boot structure in some embodiments. The protrusions may be formed on both ends of a member that is fit into a recess on the underside of the boot. A sole surface then may be attached over the member. In some embodiments, the protrusions may be detachable from the member, for example by removing a screw or other fastener.

In some embodiments, the boots may be a hard boot using materials such as rigid plastics or other suitable materials. A liner (not shown) may also be employed and inserted into the interior region of the boots, however, the present invention is not limited in this respect. A tongue stiffener, whether removable or not, may be employed to stiffen an otherwise flexible tongue.

Release of Boot Heel

In an alternative embodiment of a release assembly to release the boot engagement member from the binding, a release handle 502 includes a graspable portion 503 on the outside of the heel cup 112 and attached to a pivot pin 506 which passes through heel cup 112. An actuation portion 509 is attached to the pivot pin 506 on the inside of the heel cup. When the graspable portion 503 is rotated upwardly, the pivot pin 506 rotates and the actuator portion rotates downwardly, thereby rotating release actuator 504 to release the pawl(s) or other engagement elements from the boot. By having the pivot pin pass through the heel cup 112, the actuation portion is positioned on the inside of the heel cup, thereby reducing the overall profile of the binding as compared to the embodiment illustrated in FIG. 19.

A locking arm 510 is pivotally mounted to the release handle 502 in some embodiments. The locking arm 510 is arranged so that the rider has to press the locking arm 510 against the bias of a spring 512 (or other biasing element) to permit the release handle to be rotated. The rider may grasp the locking arm and the graspable portion of the release handle and squeeze them toward each other in some embodiments. The locking arm prevents rotation of the release handle from a closed position to a release position in some embodiments, while in other embodiments, the locking arm prevents rotation from the release position to the closed position. In still further embodiments, such as the embodiment illustrated in FIGS. 37-40, the locking arm prevents both types of rotation.

Figure 39:
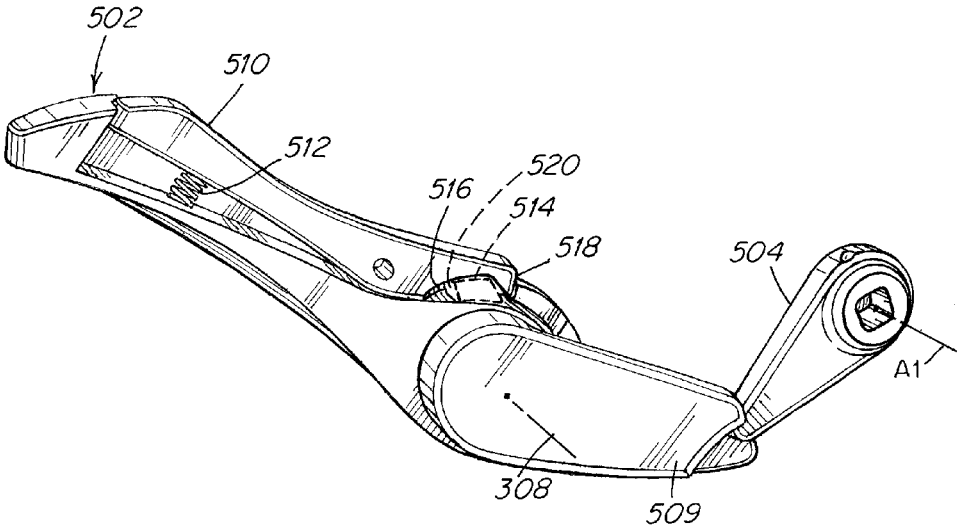
FIG. 39 shows components of the release assembly of FIG. 37 in a boot release position.
Figure 40:
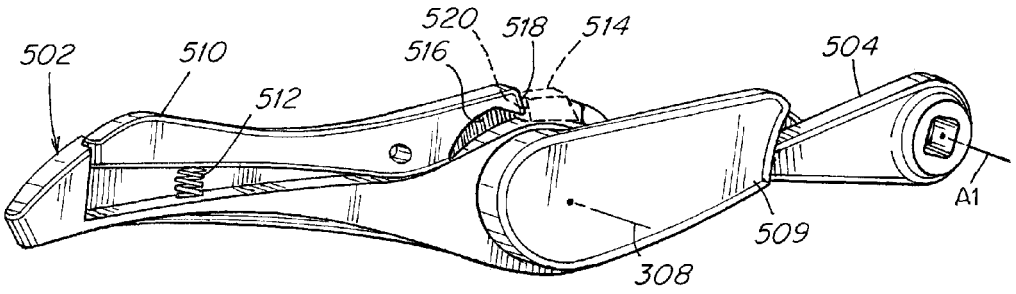
FIG. 40 shows components of the release assembly of FIG. 37 in a boot engagement position.

To prevent rotation unless the locking arm is squeezed, a lock portion is positioned on the locking arm to interact with a lock protrusion on the heel cup. One example of a lock protrusion 514 is shown on the heel cup in FIG. 38. As can be seen in FIGS. 39 and 40, the locking arm 510 includes a first locking portion, which is a recess 516 in the underside of the locking arm 510, and a second locking portion, which is a rear surface 518 of the locking arm 510.

When the release handle 502 is in a release state, and the locking arm 510 is not squeezed, the locking protrusion 514 of the heel cup (shown in dashed lines in FIG. 39) has a rear surface which contacts a surface of the recess 516 in the underside of the locking arm. This interaction prevents downward movement of the release handle 502 until the locking arm 510 is pressed against the release handle 502.

When the release handle 502 is in a closed state, and the locking arm 510 is not squeezed, the locking protrusion 514 of the heel cup (shown in dashed lines in FIG. 40) has a front surface 520 which blocks a rear surface 522, thereby preventing upward rotation of the release handle 502. When the locking arm 510 is squeezed against the release handle 502, the rear surface 522 of the locking arm pivots upwardly to a position where it clears the locking protrusion 514.

The above aspects and embodiments of the disclosure may be employed in any suitable combination as the present invention is not limited in this respect. Also, any or all of the above aspects may be employed in a snowboard boot, snowboard binding, or snowboard; however, the present disclosure is not limited in this respect, as aspects of the disclosure may be used on any type of footwear, footwear binding, or gliding board.

For purposes herein, "gliding board" refers generally to any board type structure, as well as to other devices, which allow a rider to traverse a surface. Some non-limiting examples of a gliding board include a snowboard, snow skis, water skis, wake board, kite board, surfboard and the like. For ease of understanding, however, and without limiting the scope of the invention, aspects of the disclosure are discussed herein in connection with a snowboard.

It also is to be appreciated that the step-in embodiments described herein may include a strap, such as any the straps found in strap type bindings (also known as a tray binding) having one or more of a toe strap, an instep strap and a shin-strap. For example, the step-in binding described herein may include a rear step-in engagement and a toe strap, thereby creating a hybrid strap/step-in binding. Further, as mentioned, the binding arrangement may include a boot/binding interface, which may also be considered a hybrid binding, where an interface may be strapped to the boot and the interface can have the step-in engagement features to allow the interface to step into the binding. Other arrangements for retaining a rider's boot to a snowboard are also contemplated. Further, any of the foregoing snowboard bindings may include a highback and, additionally, a forward lean adjuster for setting the forward lean of the highback. Aspects of the invention are not limited to any particular style of binding, whether or not expressly described herein. Further, a binding may be configured for compatibility with a snowboard having a channel-type mounting arrangements, a 4×4 fastener insert pattern, a 3D™ fastener insert pattern, as well as other binding interface systems as should be apparent to one of skill in the art.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

It should be understood that the foregoing description of the invention is intended merely to be illustrative thereof and that other embodiments, modifications, and equivalents of the invention are within the scope of the invention recited in the claims appended hereto. Further, although each embodiment described above includes certain features, the invention is not limited in this respect. Thus, one or more of the above-described or other features of the boot or methods of use, may be employed singularly or in any suitable combination, as the present invention is not limited to a specific embodiment.

What is claimed is:

1. An apparatus comprising:

a snowboard boot having a cleat located on a backstay region of the boot, the cleat at least partially securing the snowboard boot to a snowboard binding, the cleat forming a T-shape in a cross section taken perpendicular to a heel-calf direction of the cleat, the T-shape of the cleat configured to be received in the binding to limit forward movement of the boot; wherein when the boot is secured to the binding, the cleat contacts the binding to limit forward movement of the boot relative to the binding, and the cleat is prevented from upward movement out of the binding; and while the cleat is prevented from upward movement out of the binding, the cleat is able to contact the binding to limit forward movement of the boot relative to the binding in either of two or more different positions of the rear of the boot relative to the rear section of the binding in an up-down direction.

2. An apparatus as in claim 1, wherein the cleat includes a first engagement surface engageable with a binding engagement member on the snowboard binding to resist upward movement of the snowboard boot when the cleat is attached to the snowboard boot and is engaged with the snowboard binding.

3. An apparatus as in claim 2, in combination with the snowboard binding, wherein the first engagement surface comprises a serration, and the binding engagement element comprises a pawl.

4. An apparatus as in claim 1, wherein the cleat forms a T-shape in a cross section taken perpendicular to the heel-calf direction of the cleat along a majority of the length of the cleat.

5. An apparatus as in claim 1, in combination with the snowboard binding, wherein the binding includes a slot into which the cleat is inserted wherein a portion of the T-shape of the cross section of the cleat prevents forward movement of the boot within the binding.

6. An apparatus as in claim 1, wherein the cleat is attached to a rearwardly-facing portion of the backstay region of the snowboard boot.

7. An apparatus as in claim 1, wherein the cleat is removably attached to the snowboard boot.

8. An apparatus comprising:

a snowboard boot; and a boot engagement member coupled to the snowboard boot to at least partially secure the snowboard boot to a snowboard binding, the boot engagement member including a support coupled to and extending rearwardly away from a rearwardly-facing region of the snowboard boot, and a first forwardly-facing contact surface attached to the support to resist forward movement of the boot through contact with the binding when the snowboard boot is engaged with the snowboard binding; wherein when the boot is secured to the binding, the first forwardly-facing contact surface contacts the binding to limit forward movement of the boot relative to the binding, and the boot engagement member is prevented from upward movement out of the binding; and while the boot engagement member is prevented from upward movement out of the binding, the forwardly-facing surface is able to contact the binding to limit forward movement of the boot relative to the binding in either of two or more different positions of the rear of the boot relative to the rear section of the binding, in an up-down direction.

9. An apparatus as in claim 8, further comprising:

a first engagement element on the boot engagement member which is engageable with a binding engagement member on the snowboard binding to resist upward movement of the snowboard boot when the snowboard boot is engaged with the snowboard binding; and a second engagement element on the boot engagement member which is engageable with a binding engagement member on the snowboard binding to resist upward movement of the snowboard boot when the snowboard boot is engaged with the snowboard binding, the second engagement element being positioned higher on the boot engagement member than the first engagement element.

10. An apparatus as in claim 9, wherein each of the first and second engagement elements comprises a serration.

11. An apparatus as in claim 9, wherein the first forwardly-facing contact surface extends from a distal end of the support member toward either a medial side or a lateral side of the boot.

12. An apparatus as in claim 9, wherein the boot engagement member is removably attached to the snowboard boot.

13. An apparatus as in claim 12, further comprising a first boot protrusion on a medial side of a toe region of the boot, and a second boot protrusion on a lateral side of a toe region of the boot.

14. An apparatus as in claim 13, in combination with the snowboard binding, wherein the binding includes a first catch to capture the first boot protrusion, and a second catch to capture the second boot protrusion, wherein an engagement of the first and second boot protrusions with the first and second catches, respectively, prevents upward movement of the toe region of the boot, and does not prevent forward movement of the toe region of the boot.

15. An apparatus as in claim 9, further comprising a second forwardly-facing contact surface attached to the support to resist forward movement of the boot through contact with the binding when the snowboard boot and is engaged with the snowboard binding, each of the first forwardly-facing surface and the second forwardly-facing surface being elongated in an up-down direction, wherein:

the first elongated forwardly-facing contact surface extends in a lateral direction away from the support, and the second elongated forwardly-facing contact surface extends in a medial direction away from the support.

16. An apparatus as in claim 15, wherein the support and the first and second elongated forwardly-facing surfaces form a T-shape in a horizontal cross section.

17. An apparatus as in claim 16, wherein the support and the first and second elongated forwardly-facing surfaces form a T-shape in a horizontal cross section along substantially the entire length of the support.

18. An apparatus as in claim 9, wherein the support is elongated in an up-down direction.

19. An apparatus as in claim 8, wherein the support is coupled to and extends rearwardly away from a backstay of the boot.

20. An apparatus comprising:

a snowboard boot;

a boot engagement member to at least partially secure the snowboard boot to a snowboard binding, the boot engagement member being located on a rearwardly-facing region of a rear of the snowboard boot, the boot engagement member including:

a forwardly-facing contact surface which counteracts forward forces on the boot via contact with the binding when the boot is engaged with the snowboard binding, wherein a rearward direction force on the forwardly-facing contact surface pulls rearwardly on the boot at a location on the boot that is directly forward of an area where the forwardly-facing contact surface contacts the binding;

a first engagement element on the boot engagement member which is engageable with a binding engagement member to resist upward movement of the snowboard boot when the boot engagement member is attached to the snowboard boot and is engaged with the snowboard binding; and a second engagement element on the boot engagement member which is engageable with a binding engagement member to resist upward movement of the snowboard boot when the boot engagement member is attached to the snowboard boot and is engaged with the snowboard binding, the second engagement element being positioned higher on the boot engagement member than the second interface engagement element.

21. An apparatus as in claim 20, wherein the forwardly-facing surface is elongated in an up-down direction.

22. An apparatus as in claim 20, wherein the first engagement element on the boot engagement member comprises a serration to engage a pawl, and the second engagement element on the boot engagement member comprises a serration to engage a pawl.

23. An apparatus as in claim 20, wherein the forwardly-facing contact surface is attached to a rear side of a support member, the support member being coupled to and extending rearwardly away from the rearwardly-facing region of the snowboard boot.

24. An apparatus as in claim 20, wherein the boot engagement member is attached to the snowboard boot.

25. An apparatus comprising:

a snowboard boot;

a cleat extending rearwardly away from a rear of the boot, the cleat including a support and a forwardly-facing surface extending transversely to the support and spaced from the rear of the boot;

a binding to secure the boot to a snowboard, the binding having a rearwardly-facing surface located in a heel hoop region of the binding; wherein when the boot is secured to the binding, the forwardly-facing surface of the cleat contacts the rearwardly-facing surface of the binding to limit forward movement of the boot relative to the binding, and the cleat is prevented from upward movement out of the binding; and while the cleat is prevented from upward movement out of the binding, the forwardly-facing surface and the rearwardly facing surface are able to contact one another to limit forward movement of the boot relative to the binding in either of two or more different positions of the rear of the boot relative to the rear section of the binding in an up-down direction.

26. An apparatus as in claim 25, wherein at least two of the two or more different positions of the rear of the boot relative to the rear section of the binding are separated by at least three millimeters.

27. An apparatus as in claim 25, wherein two adjacent positions of the two or more different positions of the rear of the boot relative to the rear section of the binding are separated by no more than six millimeters.

28. An apparatus as in claim 25, wherein two adjacent positions of the two or more different positions of the rear of the boot relative to the rear section of the binding are separated by no more than three millimeters.

29. An apparatus as in claim 25, wherein the forwardly-facing surface is elongated in the up-down direction.

30. An apparatus as in claim 25, wherein:

the binding includes a pawl; and a rearwardly-facing surface of the cleat includes at least two serrations, each serration adapted to engage the pawl.

* * * * *